United States Patent [19]

Carter

[11] 4,430,166

[45] Feb. 7, 1984

[54] METHOD AND APPARATUS FOR ELECTRO-TREATING A METAL STRIP

[75] Inventor: William A. Carter, Munster, Ind.

[73] Assignee: Inland Steel Company, Chicago, Ill.

[21] Appl. No.: 424,858

[22] Filed: Sep. 27, 1982

[51] Int. Cl.[3] ..... C25D 5/02; C25D 17/00; C25D 17/10

[52] U.S. Cl. ..... 204/15; 204/206; 204/224 R; 204/290 R

[58] Field of Search ..... 204/15, 206, 224 R, 204/290 R

[56] References Cited

U.S. PATENT DOCUMENTS

| | | | |
|---|---|---|---|
| 2,961,395 | 11/1952 | Icxi | 204/224 R |
| 3,008,892 | 9/1957 | Owen | 204/207 |
| 3,048,528 | 11/1959 | Covington | 204/141 |
| 3,374,159 | 3/1968 | Poole | 204/224 R |
| 3,541,083 | 11/1970 | Beemer | 204/206 |
| 3,591,467 | 5/1971 | Carter | 204/28 |
| 3,619,383 | 5/1971 | Eisner | 204/35 R |
| 3,629,077 | 6/1971 | Gannoe | 204/28 |
| 4,310,403 | 3/1981 | Nitto et al. | 204/206 |

*Primary Examiner*—T. M. Tufariello

*Attorney, Agent, or Firm*—Merriam, Marshall & Bicknell

[57] ABSTRACT

An apparatus and method for electro-treating one surface of a metal strip alone or both surfaces sequentially. Another embodiment electro-treats both surfaces simultaneously. All embodiments employ a roll having an electrically conducting outer surface around a substantial portion of which is wrapped the strip. An electrically insulating mesh layer is interposed between the strip and the roll's outer surface, and electrolytic liquid floods the openings in the mesh layer and is retained there by that portion of the strip which is wrapped around the roll. The strip is advanced in a downstream direction, and the roll is simultaneously rotated. The strip and the outer surface of the roll are electrically charged with opposite polarities, but neither one is immersed in a bath of electrolytic liquid. Cations flow between the roll and the wrapped-around portion of the strip through the liquid in the openings of the mesh layer.

83 Claims, 14 Drawing Figures

METHOD AND APPARATUS FOR ELECTRO-TREATING A METAL STRIP

BACKGROUND OF THE INVENTION

The present invention relates generally to a method and apparatus for electro-treating a metal strip and more particularly to a method and apparatus for electro-treating either one surface or both surfaces of the strip in a continuous operation.

An example of electro-treating is the electrolytic plating of a surface of a metal strip, e.g., electrolytic galvanizing wherein a steel strip is plated with zinc. Other examples of electro-treating include the electrolytic cleaning or pickling of a surface of the metal strip.

In a typical electro-treating process, a continuous metal strip is passed through a bath of electrolytic liquid contained in a tank. Electrical charges are provided so that the metal strip constitutes one electrode in an electrolytic cell with another electrode being located in contact with the electrolytic liquid. An electric current flows through the electrolytic liquid between the metal strip and the other electrode, and, depending upon whether the metal strip is to be plated or cleaned, ions flow to or from a strip surface to be either deposited thereon or removed therefrom.

For example, in an electro-galvanizing operation, the metal strip is provided with a negative charge, so as to be a cathode, metallic anodes are placed in adjacent relation to the metal strip, and the electrolytic liquid contains zinc ions. The anodes may be depletable, in which case they are composed of zinc.

If both surfaces of the metal strip are to be coated with zinc, a zinc anode is placed alongside each surface of the metal strip, adjacent thereto. If only one surface of the metal strip is to be coated with zinc, a zinc anode is placed alongside only one surface of the metal strip, and an attempt is made to prevent zinc cation's from depositing on the other surface. In most one-sided electro-galvanizing operations there is a tendency for cation's to deposit on the side edges of the strip and adjacent the side edges on the strip surface opposite that which is alone intended to be plated.

A number of procedures have been employed in the past to produce a one-sided electro-galvanized coating. One such procedure employs a horizontally disposed roller covered with a non-conductive material such as rubber. The metal strip is wrapped around a substantial portion of that roller. The inner surface on the wrapped portion of the strip is in close contacting engagement with the roller's rubber outer layer, and the outer surface of the strip is exposed. The roller is located within the bath of electrolytic liquid. Also located within the bath of electrolytic liquid, and spaced a very short distance from the outside surface of the rubber-coated roller and from the strip in an arcuate-shaped anode of zinc which is concentric with the outside surface of the roller. A multiplicity of such roller-arcuate anode arrangements (e.g., 20 to 40) are located in series in the tank.

The strip is advanced in a downstream direction, and the rollers are rotated. When current is applied to the electrolytic cell composed of the metal strip, the electrolytic liquid and the arcuate anodes, zinc is deposited from the anodes onto the exposed surface of the metal strip, while the inner surface of the metal strip, in close contacting engagement with the rubber outer layer on the roller, is, for the most part, protected against the deposition of zinc cations thereon.

However, even with the procedure described in the preceding paragraph, there is some deposition of zinc along the side edges of the strip and adjacent the side edges of the strip on the strip surface opposite that which is alone intended to be coated.

It is sometimes desirable to differentially coat a metal strip with different amounts of coating metal on each of the two surfaces of the strip. Employing the abovedescribed prior art procedure for electro-coating only one strip surface at a time, a complicated arrangement must be utilized in order to turn the strip around so that the surface which was previously exposed to the electrolytic liquid is now pressed against the rubber outer layer on the roll and the surface which was previously protected from the electrolytic liquid is now exposed thereto.

The rate with which coating metal is deposited on a metal surface is directly proportional to the current density in the electrolytic cell. Current density is expressed as amperes per unit area of metal surface undergoing coating. It is desirable to maximize the current density for a given voltage applied to an electrolytic cell. For a given voltage, current density decreases with an increase in electrical resistance along the path in the electrolytic liquid along which the cations must pass before they can be deposited upon the surface undergoing coating. Resistance increases with an increase in the distance the cations must travel before they are deposited upon a surface. A typical voltage applied to an electrolytic continuous galvanizing cell is about 15 volts. For such a voltage, the current density usually obtained in prior art continuous electrolytic galvanizing operations is in the range 500–1,000 amps./ft.$^2$ (5,380–10,760 amps./m$^2$), at best. In one-sided galvanizing operations of the type described above, where the anode is depletable, the distance which the cations must travel increases as the anode depletes, thereby increasing the resistance and decreasing the current density as the process continues.

SUMMARY OF THE INVENTION

In accordance with the present invention there is provided an electro-treating method and apparatus which can effectively and efficiently plate, clean or pickle one surface of the metal strip without affecting the other surface; which can be used readily to treat both surfaces of the metal strip either sequentially or simultaneously; and which maximizes the current density available for a given voltage.

The present invention employs a series of horizontally disposed cylindrical rolls each having an outer surface composed of electrically conductive material. Each roll is located totally above a bath of electrolytic liquid, and the roll itself is not in contact with the bath. A continuous metal strip having opposed flat surfaces is wrapped around a substantial portion of each such roll, e.g., alternately over and under successive rolls, with an inner surface of the strip adjacent the conductive outer surface of the roll. The metal strip is advanced in a downstream direction, and each roll is simultaneously rotated while maintaining the wrapped-around relationship between the strip and the roll.

As the strip advances in a downstream direction, electrolytic treatment is performed on the inner surface of the wrapped-around portion of the strip, from one side edge of the strip to the other side edge thereof, without affecting any treatment on the other surface of the strip. This is accomplished by maintaining an electrolytic liquid between the roll outer surface and the inner surface of the wrapped-around portion of the strip, from one side edge of the strip to the other side edge thereof, while, at the same time, maintaining the outer surface of the strip out of contact with the electrolytic liquid.

The arrangement described in the preceding sentence is accomplished by employing a layer of mesh covering the outer surface of the roll. The mesh is composed of electrically insulating material which prevents direct electrical contact between the strip and the outer roll surface. The roll outer surface and the mesh together define a multiplicity of open-end electro-treating sites each having an inner base defined by a part of the roll outer surface, side-enclosing side walls defined by a part of the mesh, and an open outer end opposite the base. Wrapping the continuous metal strip around a portion of the roll outer surface closes the sites on the wrapped portion of the roll. As the strip advances in a downstream direction and the roll rotates, those sites which were previously covered become uncovered, and sites on a portion of the roll previously not wrapped by the strip become covered.

An electrolytic liquid is introduced onto the outer surface of the roll to flood the sites closed by the strip as the strip advances and the roll rotates. The outer surface of the roll is provided with a charge having a first polarity, and the strip is provided with a charge having a polarity opposite that with which the roll outer surface is charged. This creates an electrolytic cell at each closed site wherein that portion of the roll outer surface defining the site's inner base is one electrode, that portion of the strip's inner surface closing that site is the other electrode and the electrolytic liquid confined within the closed site is the electrolytic bath. If electroplating is desired, the strip is charged negatively and the roll outer surface is charged positively. For electropickling reverse polarities are provided. For electrocleaning the polarity of a roll outer surface is alternated between negative and positive respectively to clean the strip and to break up scum which can form on the roll outer surface during cleaning.

The depth of the mesh layer is relatively small (e.g., 0.06 inches (1.5 millimeters)). Accordingly, the depth of the sites or cells is relatively small, and the resistance is also relatively small. Therefore, for a given voltage, a relatively high current density is obtained. For example, at 15 volts, a current density in the range 900–1,500 amps./ft.$^2$ (0,690-16-b 145 amps./m$^2$) is obtainable.

For electroplating purposes, the outer surface of the roll may be composed of the plating metal (e.g., zinc) in which case the roll would be depletable, or the outer surface of the roll may be composed of some other metal (e.g., lead) or of a non-metallic conductive material such as graphite, in which case the cations of metal to be coated on the inner surface of the metal strip must come solely from the electrolytic liquid which is provided with cations at some external source, in a conventional manner.

The continuous strip may be wrapped around the lower portion of the horizontally disposed roll, in which case the top surface of the strip would be the inner surface and would undergo electro-treating; or the strip may be wrapped around the upper portion of the roll, in which case the bottom surface of the strip would be the inner surface thereof and would undergo electro-treating. A given process may employ a multiplicity of rolls at some of which the top surface of the strip undergoes elecro-treating and at others of which the bottom surface of the strip undergoes electro-treating.

Because the inner surface of the strip is in contact with the electrolytic liquid, while the outer surface of the strip is not, the deposition of cations on the outer surface of the strip is effectively prevented.

In addition to coating only one surface of the metal strip, the present invention may be utilized to coat both surfaces of the metal strip at different times in the process and with equal or different respective amounts of the same plating metal.

A method and apparatus in accordance with the present invention may be employed to coat one surface of the strip with one metal and the other surface of the strip with another metal. A method and apparatus in accordance with the present invention may also be employed to coat the strip surface with a metal not only by electrodeposition of cations of that metal but also by the deposit and entrapment of very fine powdery particles of the metal, as will be explained in detail subsequently.

An embodiment of a method and apparatus in accordance with the present invention may be utilized to simultaneously coat both surfaces of the metal strip. This is accomplished by utilizing an arcuate anode, of the type previously used by the prior art, to coat the outer surface of the strip while simultaneously coating the inner surface of the strip in the new manner described in the preceding paragraphs. In this embodiment of the invention, the arcuate anode is located totally outside of the bath of electrolytic liquid, and electrolytic liquid is provided only between the anode and the outer surface of the strip.

Other features and advantages are inherent in the structure claimed and disclosed or will become apparent to those skilled in the art from the following detailed description in conjunction with the accompanying diagrammatic drawings.

DETAILED DESCRIPTION

Figure 1:
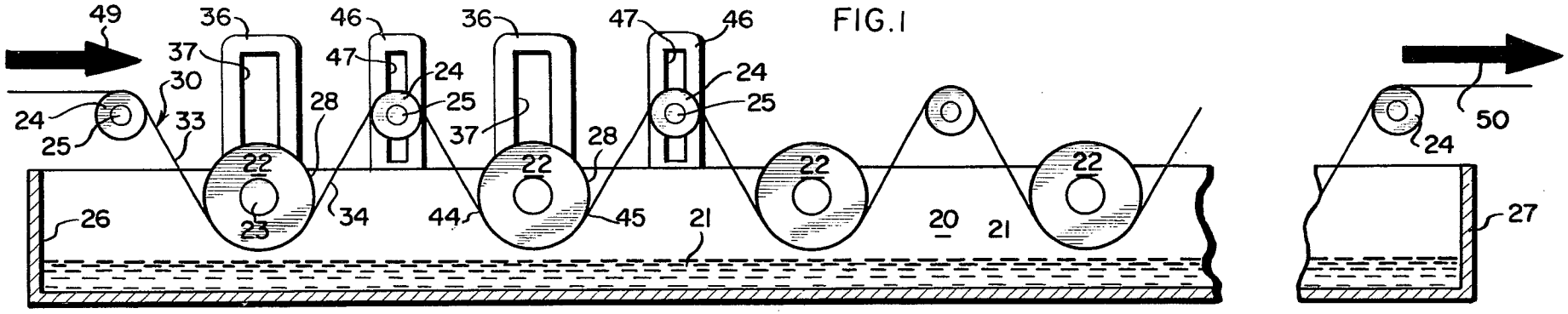
FIG. 1 is a schematic illustration, in side sectional view, of an embodiment of a method and apparatus in accordance with the present invention.

Referring initially to FIGS. 1–2 and 6–8, there is illustrated an embodiment of an apparatus and method in accordance with the present invention and comprising a tank 20 having upstream and downstream ends 26, 27, respectively, and containing a bath 21 of electrolytic liquid. Located above bath 21 are a plurality of cylindrical rolls 22, 22 each having an outer surface 28 composed of electrically conductive material. Each cylindrical roll 22 comprises a shaft 23 which rotatably mounts cylinder 22 employing conventional bearing structure (not shown). Located between each pair of cylindrical rolls 22, 22, as well as at the upstream and downstream ends of tank 20 are a plurality of additional cylindrical rolls 24, 24 each having a shaft 25 and each rotatably mounted employing conventional bearing structure (not shown). Rolls 22, 22 and 24, 24 are electrically isolated from the rest of the apparatus in a conventional manner commonly employed in the electrotreating of metal strip.

Figure 6:
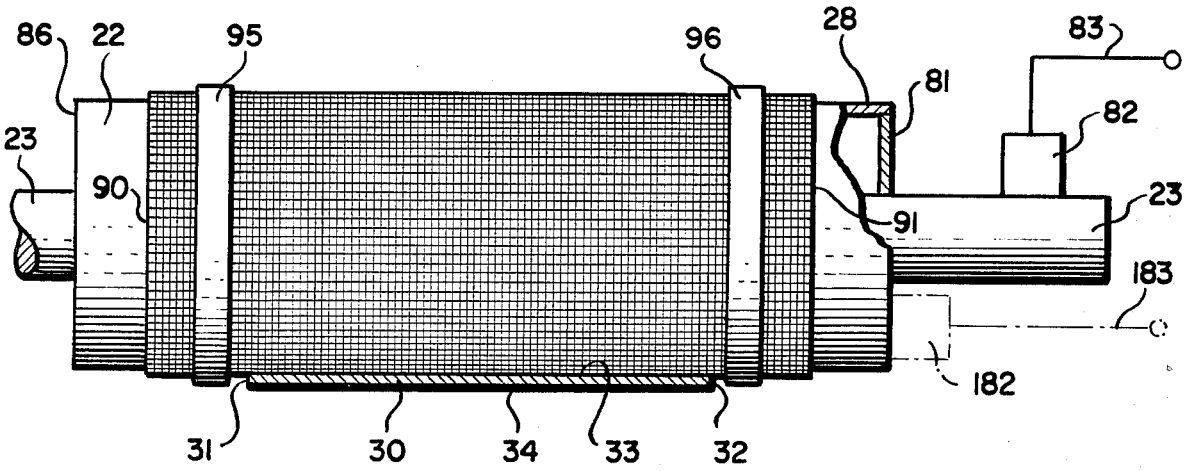
FIG. 6 is a side view, partially in section and partially cut away, of a cylindrical roll covered with a mesh layer and used in accordance with an embodiment of the present invention.
Figure 8:
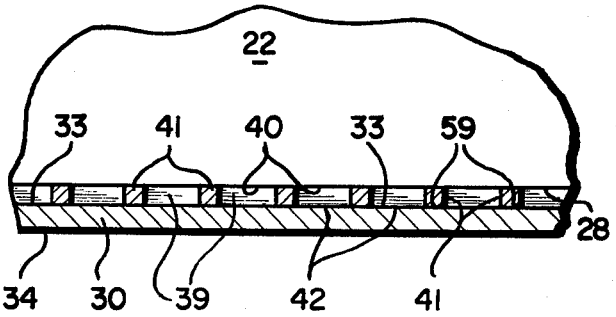
FIG. 8 is an enlarged fragmentary view, partially in section, of the roll, the mesh layer and the metal strip in the relationship they occupy in the present invention.

Trained alternately over the top portion of a roll 24 and then under the bottom portion of a roll 22 is a continuous metal strip 30 having a pair of side edges 31, 32 (FIG. 6), a top or inner surface 33 and a bottom or outer surface 34 (FIGS. 6 and 8).

Covering the greater part of outer surface 28 of each roll 22 is a removable mesh layer 38 (FIGS. 2 and 6–8) composed of electrically insulating material. Mesh layer 38 is interposed between roll outer surface 28 and metal strip 30 and comprises means for preventing direct electrical contact between strip 30 and roll outer surface 28. Roll outer surface 28 and mesh layer 38 define a multiplicity of non-communicating open-end electro-treating sites 39, 39 (FIGS. 7–8), each having an inner base 40 defined by a part of roll outer surface 28, site-enclosing side walls 41, 41 defined by a part of mesh layer 38 and an open outer end 42 opposite base 40.

Training metal strip 30 alternately around cylindrical rolls 24, 22 in the manner illustrated in FIG. 1 causes a portion of continuous metal strip 30 to be wrapped around a substantial portion of roll 22, and this closes the sites 39, 39 on that portion of roll 22 around which the continuous metal strip is wrapped.

Figure 2:
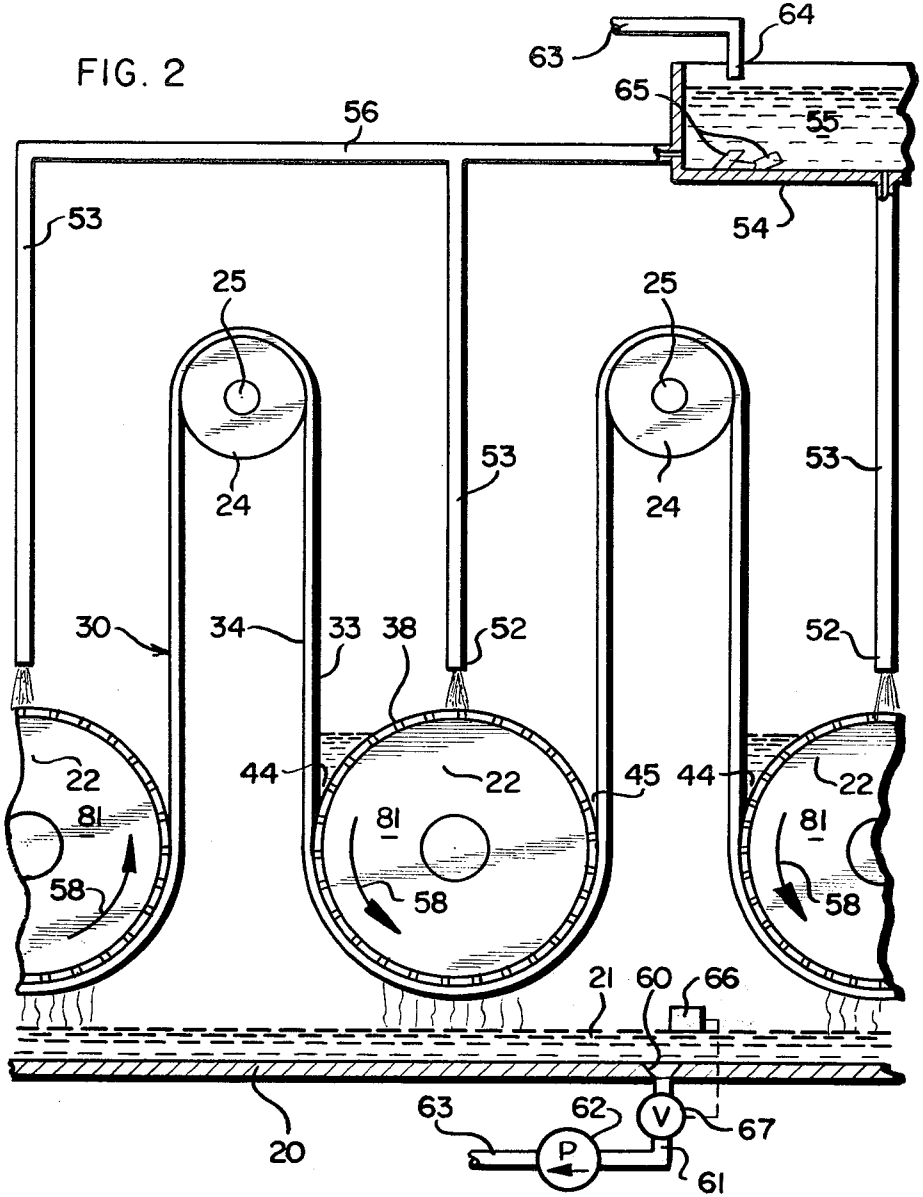
FIG. 2 is an enlarged, fragmentary, side sectional view of the embodiment of FIG. 1.

As shown in FIG. 2, wrapping metal strip 30 around roll 22 in the manner described above also provides a pair of spaced-apart nips between strip 30 and roll 22, namely an upstream nip 44 at the location of initial upstream contact between strip 30 and roll 22 and a downstream nip 45 at the location of final downstream contact between strip 30 and roll 22.

The area of contact between inner surface 33 of strip 30 and roll outer surface 28 can be varied by adjusting the vertical distance between a roll 22 and the two rolls 24, 24 on each side of that roll 22. More particularly, referring to FIG. 1, each of the first two rolls 22, 22 downstream to the right from upstream tank end 26 is shown as mounted for vertical adjustment on a mounting frame 36 having a vertical slot 37 along which shaft 23 of roll 22 may be raised or lowered, employing conventional vertical adjusting structure. Although the vertical adjusting structure at 36, 37 is shown only in connection with two of the rolls 22, 22, this structure may be employed at all of the rolls 22 in the embodiment of FIG. 1, or in any of the other embodiments, notwithstanding the fact that such vertical adjusting structure is shown only in connection with two rolls 22, 22 in FIG. 1.

Similar vertical adjusting structure comprising a frame 46 having a vertical slot 47 may be employed with each roll 24 (although, for convenience of illustration, only two such rolls are shown in FIG. 1 as being provided with such structure.) It is optional to provide rolls 24, 24 with vertical adjusting structure, while it is preferable to provide rolls 22, 22 with such structure to permit the raising of a roll 22 to facilitate the removal or replacement of mesh layer 38 when the latter has become worn.

After metal strip 30 is trained around the rolls 24 and 22 in the manner shown in FIG. 1, the rolls are vertically adjusted to provide a tight engagement between inner strip surface 33 and outer surface 28 of roll 22 (FIG. 2) and so that the area of contact between strip 30 and roll outer surface 28 is substantial. For example, strip 30 should be wrapped around a 120°–270° portion of roll outer surface 28, e.g., a 180° portion, as in FIG. 2.

Strip 30 is advanced in a downstream direction, as indicated by arrows 49, 50 in FIG. 1, by conventional driving structure (not shown) which may be located downstream (to the right) of the structure illustrated in FIG. 1. Simultaneously with the advancement of metal strip 30 in a downstream direction, roll 22 is rotated at the same speed as strip 30 so as to avoid slippage between the roll and the strip while maintaining the wrapped-around relationship between strip 30 and roll 22. In this connection, rolls 22, 22 may be idler rolls driven by the movement of strip 30 or they may themselves be driven by driving structure of a conventional nature not shown. The same driving arrangement may be utilized for rolls 24, 24 as for rolls 22, 22. That is, they may be idler rolls or they may have their own driving structure. The important consideration is that the rolls be driven at the same speed as metal strip 30 so as to avoid slippage between the strip and the rolls.

As strip 30 advances in a downstream direction and roll 22 rotates, the sites 39, 39 which were previously covered by strip 30 become uncovered, and sites 39, 39 on a portion of roll 22 previously not wrapped by the strip become covered.

Electrolytic liquid is introduced onto the top of each roll 22, to flood the sites 39, 39 between strip inner surface 33 and roll outer surface 28, employing structure shown in FIG. 2. More particularly, located above the top of each roll 22 is the outlet end 52 of a conduit 53 communicating with the bottom of a container 54 within which is located electrolytic liquid 55. Conduits 53 communicate with container 54 either directly or via a cross-conduit 56.

Rolls 22 rotate in a direction indicated by the arrows 58 in FIG. 2. Electrolytic liquid flows from conduit outlet end 52 onto mesh covered roll 22, and as the roll rotates in the direction of arrow 58, the electrolytic liquid is carried to upstream nip 44 where the liquid floods the sites closed by strip 30 as the strip advances and the roll rotates. Excess liquid is squeezed out of the sites 39 at upstream nip 44 and accumulates at the nip, eventually spilling around strip side edges 31, 32 into tank 26 where the liquid forms a bath 21 at the bottom of the tank.

Electrolytic liquid is held within a given site closed by strip 30 for as long as strip 30 is in contact with that site, i.e., for the length of time it takes for the site to travel from upstream nip 44 to downstream nip 45. As strip 30 breaks contact with mesh layer 48 at downstream nip 45, electrolytic liquid within a site at the downstream nip is no longer trapped or prevented from escaping from the site. This liquid then drains out of the site as the site is rotated beyond downstream nip 45, away from strip 30, and the liquid drops into bath 21 in tank 26.

The outer surface 28 of roll 22 is provided with a charge having a first polarity, e.g., a positive charge if strip 30 is to be electroplated, and strip 30 is provided with a charge having a polarity opposite that of roll outer surface 28, e.g., a negative charge on strip 30 if the strip is to be electroplated. The electrical charge is applied to the outer surface 28 of roll 22 with conventional structure, embodiments of which will be subsequently described, and a charge is applied to strip 30 employing conventional structure. For example, the outer surface of roll 24 may be composed of metal and provided with a positive charge which in turn will be transferred to strip 30 which is in electrically conducting contact with roll 24.

Because strip 30 and roll outer surface 28 have opposite charges, an electric current may flow between the two through the electrolytic liquid in flooded sites 39. In other words, referring to FIG. 8, at each closed site there is an electrolytic cell wherein that portion of roll outer surface 28 defining site inner base 40 is one electrode, that portion of strip inner surface 30 closing site 39 is the other electrode and the electrolytic liquid within the closed site 39 is the electrolytic bath.

In a plating operation, the electrolytic liquid contains cations of the metal to be plated, e.g., zinc cations. The flow of current between roll outer surface 28 and metal strip 30 causes cations to be deposited upon the inner surface 33 of metal strip 30.

Zinc is applied to inner strip surface 33 as the strip moves from upstream nip 44 to downstream nip 45 on each roll 22 in a sequence of rolls. The number of rolls 22, 22 strip 30 contacts depends upon the thickness of the zinc coating to be applied to strip inner surface 33. Typically, there would be twenty to forty rolls 22, 22 in a given plating line.

Plating metal is applied substantially only to that part of strip inner surface 33 which is in contact with the electrolytic liquid. Strip outer surface 34 is not in contact with electrolytic liquid, and no plating metal is applied thereto. In other words, there is no path of electrolytic liquid between (a) roll outer surface 28 and (b) strip outer surface 34 through which current can flow. To the extent that there may be some slight wrap-around of plating metal on outer surface 34, adjacent strip edges 31, 32, this wrap-around is insubstantial and insignificant for commercial purposes, e.g., the wrap-around is only about 1/16–⅛ inch (1.6–3.2 millimeters) inward from edges 31, 32.

Referring to FIG. 8, there are portions 59, 59 of strip inner surface 33 which are in contact with the site's side walls 41, 41 defined by mesh layer 38. Because these side walls are non-conductive, no zinc will be plated on those portions 59, 59 of strip inner surface 33 which are in contact with side walls 41, 41.

Strip 33 contacts twenty to forty different rolls 22 in a plating line. Mesh layer side walls 41, 41 on any one such roll are randomly oriented with respect to the side walls on the other rolls, so that side walls 41, 41 for a site 39 on any given roll 22 are not aligned with the side walls for a site 39 on most, if not all, of the other rolls 22. In other words, the sites 39 on one roll 22 overlap with the sites 39 on another roll 22. Accordingly, those portions 59, 59 on strip inner surface 33 which are unplated at one given roll 22 would not coincide with the portions 59, 59 which would be unplated at another given roll 22. Therefore, at the end of a sequence of twenty to forty rolls 22, all of the area on the inner surface 33 of a strip 30 will be plated and to essentially the same thickness.

The walls 41, 41 defined by the mesh layer are very narrow, e.g., 0.03 to 0.09 inches (0.76 to 2.29 millimeters), and each cross-sectional dimension (i.e., width or length), of a site 39 may be about 0.06 to 0.91 inches (1.52 to 23.1 millimeters), for example.

As noted above, surplus electrolytic liquid spilling from upstream nip 44 and electrolytic liquid freed from sites 39 at downstream nip 45 descend into tank 26 and accummulate in bath 21. The electrolytic liquid in bath 21 is recirculated to electrolytic liquid container 54 through the following structure. Located at the bottom of tank 26 is a drain 60 communicating with a conduit 61 in turn communicating with a pump 62 which in turn communicates with the upstream end of a conduit 63 having, at its downstream end, a nozzle 64 which feeds into container 54.

Cations are depleted from the electrolytic liquid during the plating operation, and these cations may be replenished in two different manners. In one, the outer surface 28 of roll 22 is part of a depletable anode constituting a layer of zinc, for example. In the other, anions are replenished in electrolytic liquid 55 in container 54. In such a case, there are placed within container 54 a number of zinc pieces 65, 65 which are dissolved by electrolytic liquid 55 from which zinc cations had been depleted. For example, a depleted electrolyte, e.g., a weak solution of zinc sulfate, flows through nozzle 64 into container 54 wherein zinc ions from zinc pieces 65, 65 are dissolved in the dilute zinc sulfate which then flows into conduit 53 with an increased concentration of zinc ions, compared to the concentration of the solution that entered container 54 through nozzle 64.

As an alternative to replenishing electrolytic liquid with zinc pieces in container 54, similar zinc pieces may be placed in the bottom of tank 20, and the replenishing operation is conducted in tank 20.

As noted above, the level of electrolytic liquid in bath 21 is maintained below the bottom of roll 22 and below metal strip 30 at its lowest point as it travels around roll 22 (FIG. 2). The level of bath 21 is controlled by a level sensor 66 linked to a valve 67 which controls the flow of fluid out of tank 26 through drain 60.

Figure 4:
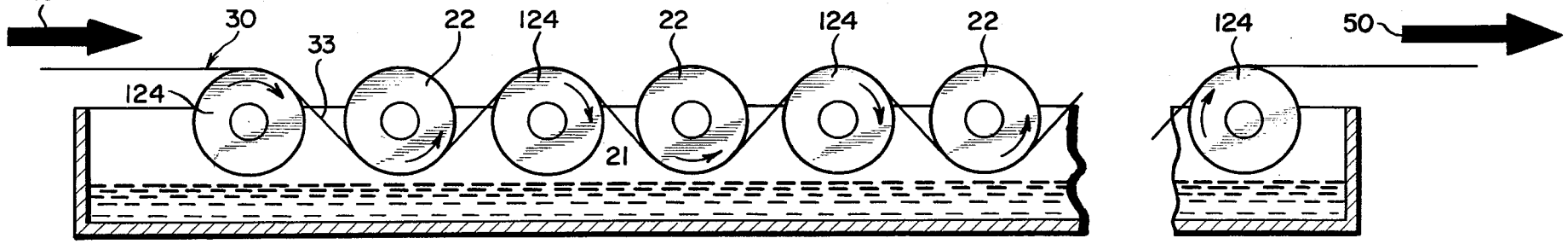
FIG. 4 is a view similar to FIG. 1 illustrating an embodiment wherein only one side of the strip undergoes electro-treatment.
Figure 5:
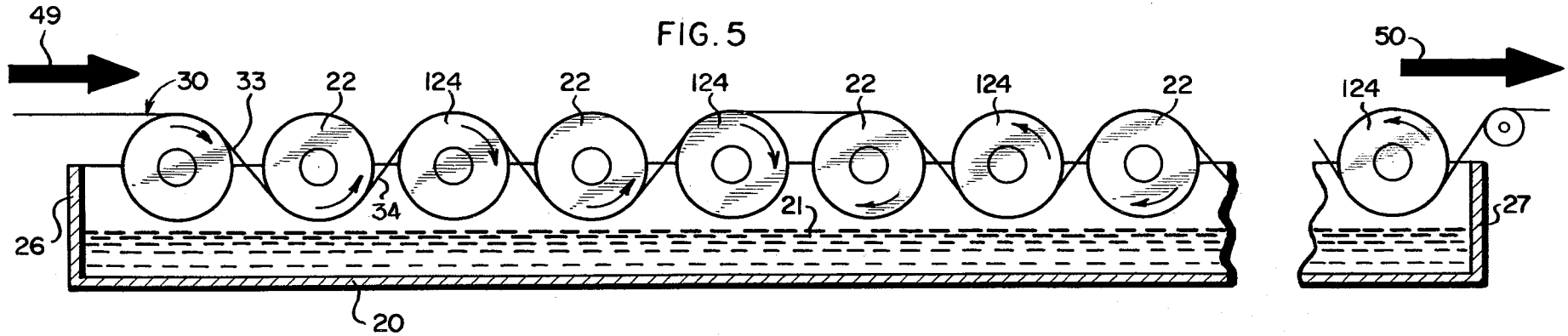
FIG. 5 is a view similar to FIG. 4 illustrating an embodiment wherein each side of the strip undergoes electro-treatment, sequentially.

FIGS. 4 and 5 illustrate schematically an embodiment of a method and apparatus, in accordance with the present invention, which may be employed to coat either a single surface of metal strip 30, or both surfaces of metal strip 30 sequentially, i.e., one surface after the other. In the arrangement illustrated schematically in FIG. 4, only top surface 33 of strip 30 is coated with zinc, and this is accomplished in the same manner as illustrated above in connection with the embodiment shown in FIGS. 1 and 2. In the arrangement illustrated in FIG. 5, initially strip top surface 33 is coated with zinc and then strip bottom surface 34 is coated with zinc, without any structural change from the apparatus used when coating only strip surface 33, as in the embodiment illustrated in FIG. 4.

More particularly, in each of the embodiments of FIGS. 4 and 5, all of the rolls 22, 22 have a positive charge and constitute the anode in the plating operation. All of the rolls 124, 124 function in the manner of rolls 24, 24 in the embodiment of FIG. 1. In the embodiment of FIG. 4, strip 30 passes over all of the rolls 124, 124 and under all of the rolls 22, 22, and strip top surface 33 is plated with zinc in the manner illustrated in the embodiment described in conjunction with FIGS. 1 and 2.

In the embodiment of FIG. 5, however, strip 30 passes over rolls 124, 124 and under rolls 22, 22 during only the first part of the electroplating line. At the third roll 22 from upstream end 26 of tank 20, strip 30 is trained over the top of this roll 22 and then under the next downstream roll 124, thereafter following a sequence of (a) over roll 22 and (b) under roll 124 the rest of the way to downstream end 27 to tank 20. When the strip passes under a roll 22, top surface 33 of the strip is plated. However, when the strip passes over a roll 22 the bottom surface 34 of strip 30 is plated. The plating of bottom surface 34 is best illustrated in FIG. 9.

More particularly, when strip 30 passes over roll 22, rather than under roll 22, the surface of the strip which closes the sites flooded by electrolytic liquid is surface 34. Accordingly, surface 34 undergoes plating rather than surface 33.

When strip 30 passes over the upper portion of roll 22, strip surface 34 closes the sites 39, 39 on that portion of the roll between (a) an upstream nip 144 at the location of initial upstream contact between strip 30 and roll outer surface 28 and (b) a downstream nip 145 at the location of final downstream contact between strip 30 and roll outer surface 28. Electrolytic liquid is introduced into the sites 39 closed by strip 30 by injecting liquid upwardly into the upstream nip at 144, through a nozzle 70 (FIG. 9).

Figure 9:
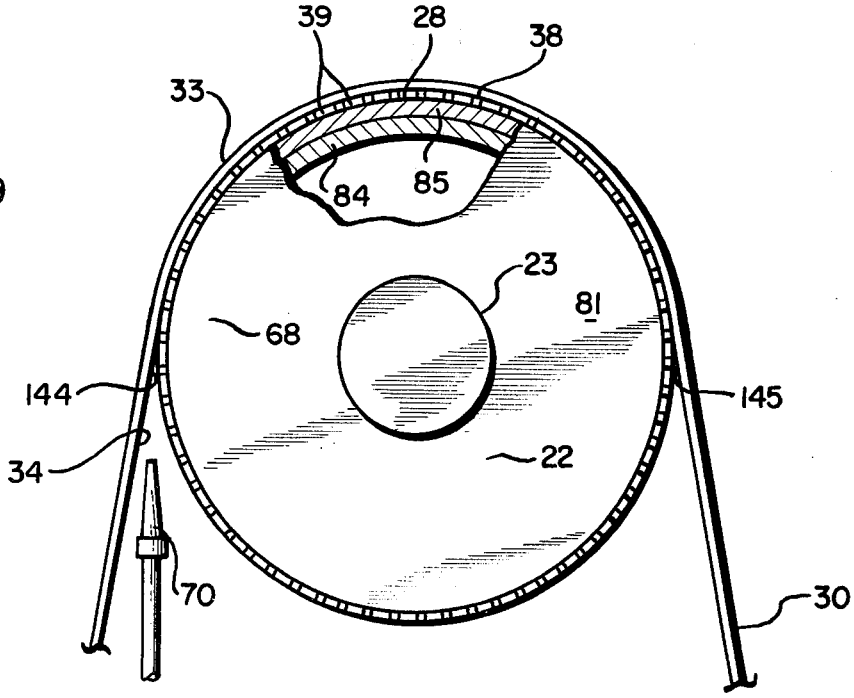
FIG. 9 is an end view, partially in section and partially cut away, illustrating an embodiment of apparatus in accordance with the present invention.
Figure 10:
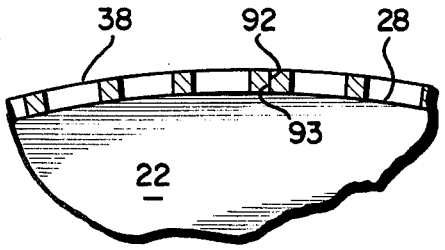
FIG. 10 is a fragmentary end view, partially in section, illustrating one embodiment of mesh layer and cylindrical roll.
Figure 11:
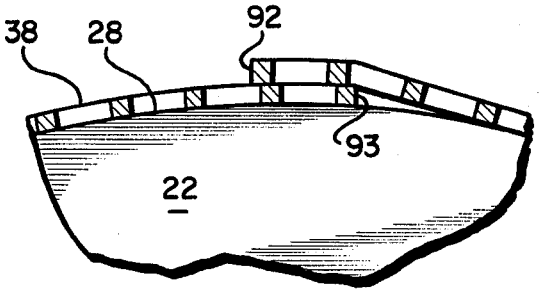
FIG. 11 is a view similar to FIG. 10 illustrating another embodiment of mesh layer and cylindrical roll.

The sites at nip 144 are flooded by liquid from nozzle 70, and, before the liquid can run out of the flooded sites, the sites are closed by strip 30 as the strip and the sites move away from nip 144 in the direction of arrow 68 in FIG. 9. The closing of the sites traps the liquid therein until the sites arrive at downstream nip 145 where the sites are opened as strip 30 moves away from roll 22.

No surplus electrolytic liquid can accumulate at upstream nip 144, and all of the liquid which was not trapped in a flooded site 39 at nip 144 drops downwardly into bath 21 in tank 20.

The embodiment illustrated in FIG. 9 can be used, like the embodiment of FIG. 2, in a process for coating one strip surface only, or it can be used for coating one surface in a process where both strip surfaces are coated sequentially, as in FIG. 5.

In the embodiments of both FIGS. 4 and 5, the rolls 22 and 124 are preferably not directly driven themselves, but, rather, are driven by the advancement of strip 30 in the downstream direction indicated by arrows 49, 50 in FIGS. 4–5. Each of the rolls 22, 124 in each of the FIGS. 4 and 5 rotates in the direction of the arrow shown on that particular roll in a respective figure.

Figure 3:
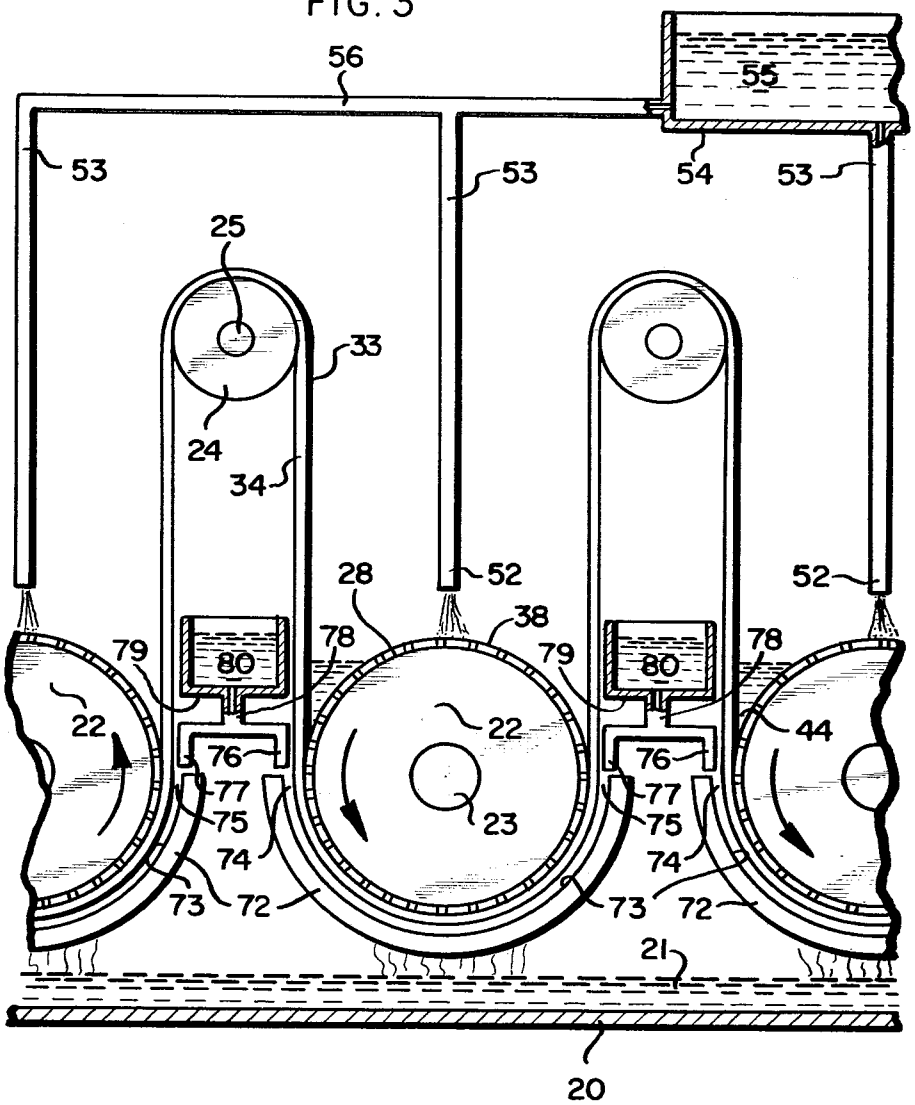
FIG. 3 is a view similar to FIG. 2 illustrating an embodiment wherein both surfaces of the metal strip are simultaneously coated.

As noted above, FIG. 5 illustrates an embodiment for coating both strip surfaces and in which initially strip surface 33 is coated and then strip surface 34 is coated, sequentially, but both strip surfaces are not coated at the same time. FIG. 3 illustrates an embodiment in which both strip surfaces 33 and 34 are coated at the same time. In the embodiment of FIG. 3, strip surface 33 is coated in the same manner and employing the same apparatus as in the embodiment of FIG. 2. However, the procedure and apparatus for coating strip surface 34 differ from that described above, and these differences will now be described, with reference to FIG. 3.

Located below roll 22, substantially concentric therewith, is a depletable arcuate electrode 72 curved to conform to the curvature of roll 22. Arcuate electrode 72 is composed of the plating metal (e.g., zinc) and is charged with the same charge as outer surface 28 of roll 22, e.g., a positive charge making electrode 72 an anode. Anode 72 and roll 22 define a space 73 therebetween, and space 73 has a dimension in a radial direction greater than the thickness of metal strip 30. As a result, when metal strip 30 is trained around the lower portion of roll 22, there is a small space or gap between surface 34 of strip 30 and the adjacent surface of anode 72.

That part of space 73 not occupied by strip 30 is filled with electrolytic liquid, and this is accomplished by providing nozzles 76, 77 at the upstream and downstream ends 74, 75, respectively, of space 73. Nozzles 76, 77 communicate with the bottom of a conduit 78 which in turn communicates with the bottom of a container 79 containing electrolytic liquid 80. Surplus liquid introduced into space 73 drains into a bath 21 located below anode 72 which is located totally above the top surface of bath 21.

Electrolytic liquid from bath 21 is circulated from tank 20 into container 79 employing conventional structure similar to that utilized to circulate liquid from bath 21 into container 55, as shown in FIG. 2. The level of bath 21 is maintained below the bottom of anode 72 employing a level sensor and valve similar to 66, 67 illustrated in FIG. 2.

The distance between strip surface 34 and the adjacent surface of anode 72 is approximately $\frac{1}{4}$ inch (6.4 millimeters). Electrolytic liquid is normally fed under pressure from nozzles 76, 77 into space 73.

At times it may be desirable to employ the apparatus illustrated in FIG. 3 to coat only one surface of strip 30. In such a case, that part of the apparatus which is utilized to coat surface 33 would be operational while that part of the apparatus utilized to coat surface 34, e.g., elements 72–80 would be non-operational. In such a case only surface 33 of strip 30 would be coated.

The method and apparatus of FIG. 2 may be utilized not only to electrolytically coat a surface of strip 30, but also to clean or pickle that surface. This may be accomplished merely by changing the charges on strip 30 and roll outer surface 28 and changing the electrolytic liquid to a cleaning or pickling solution of conventional composition. More particularly, if the charge on strip 30 is changed from negative to positive and the charge on roll outer surface 28 is changed from positive to negative, then, as electrolytic liquid is introduced in the manner shown in FIG. 2 and the strip is advanced in a downstream direction, the strip will undergo cleaning or pickling rather than undergoing plating. In the case of electro-cleaning, the charges are changed periodically to break up scum which may form on roll outer surface 28.

A charge of the desired polarity can be applied to the outer surface 28 of roll 22 by employing structure of the type illustrated in FIG. 6. More particularly, metallic outer surface 28 of roll 22 is electrically connected to a metallic end plate 81 on roll 22 which in turn is electrically connected to metal shaft 23 for roll 22. Contacting shaft 23 is a brush 82 connected by an electrical line 83 to a power source (not shown).

As an alternative to brush 82, there may be employed a brush which is in direct electrical contact with end plate 81 of roll 22. This alternative brush is illustrated in dash-dot lines at 182 and is connected by an electrical line 183 to the power source.

In the embodiment employing brush 182, end plate 81 should be composed of a highly conductive material such as copper, and brush 182 should be readily retractable in an axial direction away from end plate 81 to facilitate the removal vertically of roll 22 from the electro-treating line in instances where mesh layer 38 is to be replaced or in instances where roll 22 has a depletable outer layer 85 (FIG. 9), and the outer layer must be replaced.

The metallic outer surface of roll 24 may be provided with a charge in the same manner as is the outer surface 28 of roll 22.

As shown in FIG. 9, the cylindrical portion of roll 22 is composed of two layers, an inner layer 84 composed of steel or copper, for strength, and an outer layer 85 composed of lead or zinc. Inner layer 84 may be water cooled to offset the heat generated by electricity flowing therethrough.

Roll outer surface 28 is on outer layer 85. When roll 22 is intended to be the source of cations which replenish the electrolytic liquid, outer layer 85 is composed of zinc. When the electrolytic liquid is replenished from external sources, then the outer layer may be composed of lead or graphite. The advantages of composing outer layer 85 of zinc are that it requires less power to perform the electroplating process than does a lead anode, and it generates less heat than does a lead anode so that the electrolytic liquid needs substantially less cooling. In addition, when outer layer 85 is composed of lead, the electrolytic liquid must be a zinc sulfate solution; however, when outer layer 85 is composed of zinc, the electrolytic liquid may be either a zinc sulfate solution or a zinc chloride solution. Zinc chloride solution is a better conductor than zinc sulfate solution, thereby decreasing the resistance and increasing the current density. Zinc chloride solution cannot be used when outer layer 85 is composed of lead because a chloride skin will form on the lead anode and, in effect, kill the lead anode electrically. The chloride skin has a high electrical resistance. Zinc chloride solution can be used when outer layer 85 is composed of graphite.

Moreover, when outer layer 85 is composed of lead, the $H_2O$ in the dilute acid solution contained in the electrolytic liquid is broken down at the lead anode into hydrogen plus oxygen, and the oxygen takes up space in the sites which contain the electrolytic liquid. This reduces the amount of electrolytic liquid which can be contained in a site, which is undesirable. This is not a problem, however, when employing a zinc anode and a zinc chloride solution.

The primary disadvantage which arises when outer layer 85 is composed of zinc is that the diameter of roll 22 decreases rather rapidly as plating occurs. For example, assuming an outer layer 85 composed of zinc ½ inch (12.7 mm) thick, with a roll 22 having a three foot diameter (0.91 m) and travelling at a linear speed of 500 ft./min. (2.5 m/sec.) with a current density of 1,000 amps./ft.$^2$ (10,760 amps./m$^2$), the thickness of the zinc will be reduced by about ⅜ inch (9.5 mm) in ten hours.

When outer layer 85 of roll 22 is composed of zinc, the zinc may be provided as two semicircular pieces, or half shells, which are fixed to roll 22 with clamps, one located at each end of a roll. Each zinc anode half shell is rolled down from a slab of electrolytic zinc.

The advantage of using lead for outer layer 85 is that the lead is not depleted during the electrolytic reaction. Although a lead layer may erode, it would do so very slowly, and the lead erosion is relatively trivial compared to the shrinkage which occurs when the outer layer is composed of zinc.

Typically the lead outer layer may be ⅛ inch (3.2 mm) thick, and it may be strapped or screwed onto inner layer 84. The lead layer can also be cast or hot-dipped or electroplated onto the inner layer. The criterion is to provide intimate contact between inner layer 84 and outer layer 85 for electrical conducting purposes.

It may be desirable, when outer layer 85 is composed of lead, to chrome plate inner layer 84, in case a hole develops in the lead outer layer. The chrome plating would protect the steel or copper on the inner layer from the electrolytic plating solution which is acidic and could corrode the inner layer.

The lead outer layer may be alloyed with up to about 10% antimony, silver or tin to strengthen the lead and render it less ductile or malleable, although this may have a slight adverse affect on the electrical conductivity of the lead.

As noted above, mesh layer 38 is composed of a material which is non-conductive electrically. In addition, mesh layer 38 must be dimensionally stable. That is, it should not readily undergo a change in length or width while in use on the roll during an electro-treating operation. Dimensional stability is important because, in a preferred embodiment, the mesh layer turns the roll. More particularly, as strip 30 moves across roll 22 in a downstream direction, the strip engages mesh layer 38 which in turn engages outer surface 28 on roll 22 to rotate the roll. Mesh layer 38 should be sufficiently inelastic to resist significant deformation due to strip torque, so that the mesh won't become distorted on the roll. The mesh layer should not bend or twist relative to itself, and should retain a planar shape (i.e., remain parallel with the cylindrical outer surface 28 of roll 22.

Mesh layer 38 should be relatively chemically inert to and insoluble in the electrolytic liquid. The mesh layer should be resistant to oxidation when outer layer 85 is composed of lead and the solution is zinc sulfate, conditions under which oxygen is generated during the electrolytic reaction. Typical materials from which mesh layer 38 may be composed include polyethylene, polyvinylchloride, polyvinyldichloride, and polypropylene.

Figure 7:
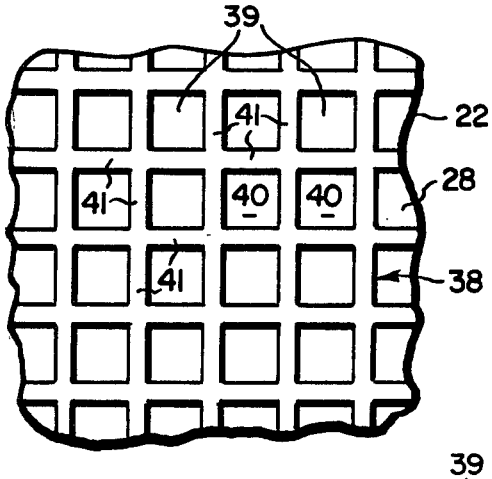
FIG. 7 is an enlarged fragmentary view of the mesh layer.

Referring to FIGS. 7 and 8, the distance between the centers of opposed side walls 41, 41 should be sufficiently small to prevent the steel strip in contact with mesh layer 38 from sagging down and touching the outer surface 28 of roll 22. For example, the distance from the center of one side wall 41 to the center of the opposed side wall 41 may be in the range 0.09–1.0 inches (2.3–25.4 millimeters) e.g., 0.38 inches (9.7 millimeters).

As noted above, the width or length of the mesh opening may be in the range 0.06 to 0.91 inches (1.52 to 23.1 millimeters), and the side walls defined by the mesh may have a thickness in the range 0.03 to 0.09 inches (0.76 to 2.29 millimeters).

The sites defined by side walls 41, 41 are shown in the drawings as having a regular, square shape, but other shapes, both regular and irregular may be employed.

The smaller the mesh opening, the less contact there is between the adjacent strip surface and the electrolytic liquid. This is because more space is taken up by side walls 41, 41 when the mesh openings are relatively small, there being more side walls in the mesh layer. Therefore, it is desirable to have a mesh opening as large as possible to facilitate maximum contact between the electrolytic liquid and the adjacent strip surface.

A larger mesh opening can be tolerated when the mesh layer is relatively deep, but this has a drawback in that it increases the length of the path in the electrolytic liquid through which cations must travel to deposit on the adjacent surface of the metal strip, thereby increasing resistance and reducing current density, which is undesirable. The depth of the mesh defines the distance between site base 40 and site end 42 covered by the adjacent strip surface (see FIG. 8). The depth of the mesh should be as small as possible so as to maximize the current density. The mesh should be deeper than any ordinary deformity in metal strip 30 so as to prevent the strip from contacting roll outer surface 28. The mesh layer should have sufficient substance to resist cutting by a deformed side edge on strip 30 or by a bad weld on the continuous metal strip. The mesh layer depth may be in the range 0.01 to 0.08 inches (0.25 to 2.0 millimeters), and a mesh layer depth of 0.06 inches (1.5 millimeters) would be a typical example.

The material of which mesh layer 38 is composed must be capable of retaining its properties at temperatures above about 120° F. (49° C.) up to about 212° F. (100° C.). Typically, the mesh layer will be exposed to average temperatures in the range 120°–150° F. (49°–66° C.) although localized temperatures can go up to 180° F. (82° C.), for example.

Referring now to FIGS. 6 and 10–14, mesh layer 38 has a pair of sides 90, 91 (FIG. 6) and a pair of ends 92, 93 (FIGS. 10–14). Mesh layer 38 is wrapped around roll 22 to which the mesh layer is unadhered, and mesh ends 92, 93 may be abutted, as in FIG. 10, or overlapped as in FIG. 11; and in both such cases the unadhered mesh layer is secured around roll 22 with straps 95, 96 (FIG. 6). Straps 95, 96 may be eliminated by securing the mesh layer to the roll using the arrangements illustrated in FIGS. 12 and 13.

Figure 12:
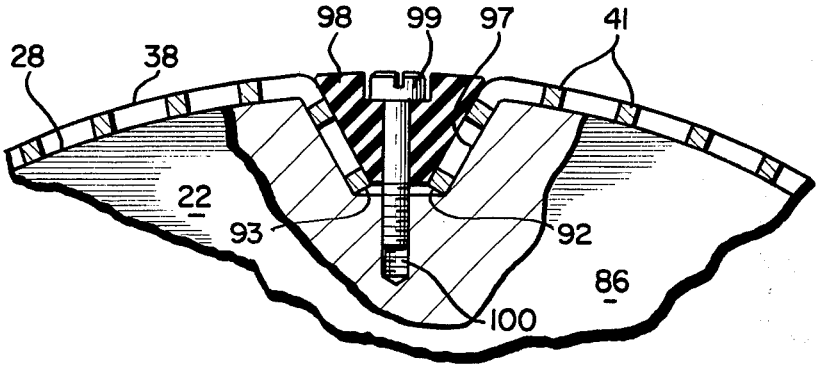
FIG. 12 is an enlarged, fragmentary end view, partially in section and partially cut away, illustrating one embodiment of structure for securing the mesh layer to the cylindrical roll.

In the arrangement of FIG. 12, roll 22 comprises a groove 97 extending along the outside of roll 22 between roll ends 81, 86. Groove 97 has radially inwardly converging sides along which are laid the portions of mesh layer 38 adjacent ends 92, 93. The end portions of mesh layer 38 are held in place within groove 97 by a non-conducting, tapered plastic bar 98 secured to roll 22 by a threaded member 99 which engages within a threaded opening 100 in roll 22.

Figure 13:
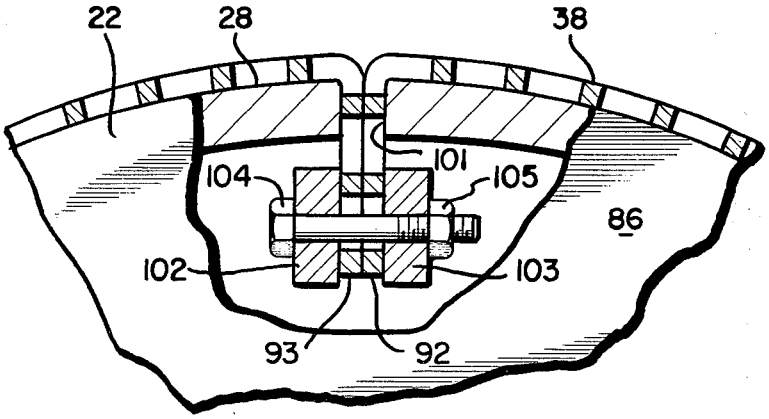
FIG. 13 is a view similar to FIG. 12 illustrating another embodiment of structure for securing the mesh layer to the cylindrical roll.

In the arrangement illustrated in FIG. 13, the mesh layer portions adjacent ends 92, 93 are secured to roll 22 by inserting the end portions through a slit 101 which extends along the outside of roll 22 between its ends 81, 86. The two end portions of the mesh layer are gripped between grip bars 102, 103 held together by a bolt 104 and a nut 105 at each end of the grip bar.

For convenience of illustration in FIGS. 12 and 13, the separate cylindrical inner and outer layers 84, 85 of roll 22 (see FIG. 9) are not shown in FIGS. 12 and 13; however, that type of multi-layer construction may be employed, as in the mesh layer-securing arrangement shown in FIG. 14 and discussed below.

In another embodiment, mesh layer 38 may be provided in the form of a cylinder having an outside diameter slightly smaller than that of roll 22. Because the mesh layer is composed of material having some elasticity, it can be stretched slightly to fit over the outside surface 28 of roll 22 and still engage tightly and snugly around roll 22. An important factor in all the embodiments of securing mesh layer 38 around roll 22 is to maintain the mesh layer in close contacting engagement with roll outer surface 28 at all times.

As noted above, when the roll's outer layer 85 is composed of zinc, the zinc becomes depleted during the electroplating operation, and the diameter of roll 22 decreases. However, it is important that mesh layer 38 be in close contacting engagement with the outer surface 28 of roll 22 at all times. Therefore, as the diameter of roll 22 decreases, mesh layer 38 must accommodate for the reduced diameter. This can be accomplished utilizing an arrangement of the type illustrated in FIG. 14.

Figure 14:
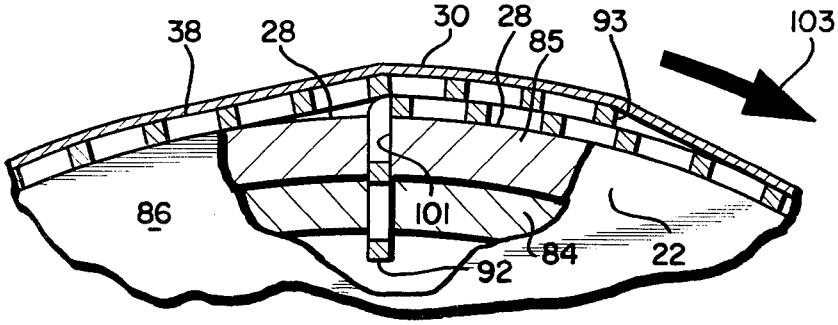
FIG. 14 is a view similar to FIGS. 12 and 13 illustrating still another embodiment of structure for securing the mesh layer to the cylindrical roll.

In the embodiment of FIG. 14, one end 92 of mesh layer 38 extends through a slit 101 in layers 84, 85 adjacent the outside of roll 22, and this end is fixed to the roll by conventional structure, e.g., a grip bar arrangement of the type shown in FIG. 13. Mesh layer 38 extends from fixed end 92 around roll outer surface 28, overlapping fixed end 92 and terminating at end 93 which is free and unfixed relative to the roll. Strip 30 is wrapped around mesh layer 38 and advances in the direction indicated by arrow 103 in FIG. 14. The frictional contact between strip 30 and the overlapped portion of mesh layer 38 tends to maintain the mesh layer in the overlapped arrangement illustrated in FIG. 14 and urges free, unfixed end 93 in the direction of arrow 103. Therefore, as the outer diameter of roll 22 shrinks, instead of there being a loosening of the engagement of mesh layer 38 around roll 22, the free unfixed end 93 of the mesh layer is advanced by the frictional urging of strip 30 in the direction of arrow 103, in effect pulling mesh layer 38 tightly around roll 22 in the manner of rolling up a window shade.

To prevent the mesh layer's free end 93 from flapping loosely during that portion of the roll's rotation in which free end 93 is unengaged by strip 30, retaining structure, such as side straps located similarly to straps 95, 96 in FIG. 6, should be employed. These side straps should be loose enough not to interfere with the tightening of the mesh layer by the advancing strip 30 but snug enough to prevent the mesh layer's free end from flapping.

That part of strip 30 which extends from slit 101 to mesh layer free end 93 overlies a double thickness of mesh layer 38, and there would be less metal plated out on that part of the strip than on strip parts overlying a single thickness of mesh layer. However, there are twenty to forty plating rolls on a plating line, and it is extremely unlikely that the same part of the strip will overlie a double mesh layer on more than one or two rolls. Therefore, the thickness of plating metal deposited on all parts of the strip is essentially uniform. The foregoing discussion is also applicable to the double thickness of mesh layer shown in FIG. 11, wherein end 92 overlaps end 93.

The arrangement of maintaining mesh layer 38 in close contacting engagement with roll outer surface 38 is illustrated in FIG. 14 in an embodiment in which strip 30 is trained over roll 22. The same arrangement may also be utilized when strip 30 is trained under roll 22 (as in FIG. 2), except that the direction in which free end 93 extends relative to slit 101 would be reversed from that shown in FIG. 14, as would the direction of rotation of roll 22.

To accommodate changes in the diameter of roll 22, in an axial direction along the roll, the mesh layer may be provided as a plurality of mesh layer portions disposed in adjacent, side-by-side relation with each mesh layer portion extending around and covering a different cylindrical portion of the outer surface of roll 22. Each of these plurality of mesh layer portions has an arrangement, in relation to the roll outer surface, of the type described above in connection with FIG. 14, and this arrangement permits each mesh layer portion to be rolled up like a window shade as the diameter of the cylindrical portion covered by that mesh layer is reduced.

The method and apparatus of the present invention may be employed for the compound plating of both (a) particles of metallic or non-metallic powder suspended in the electrolytic liquid and (b) cations of metal in solution in the liquid. This can be accomplished by initially suspending the particles of powder in the electrolytic liquid and maintaining them in suspension by vigorous agitation. The suspension and agitation would be performed, for example, in container 54 (FIG. 2). The suspended powder particles are introduced into the sites 39, 39 along with the electrolytic liquid, and, as metal ions are plated out from the electrolytic liquid onto the strip surface at a closed site, the suspended powder particles immediately adjacent the strip surface are cemented or anchored onto the strip surface by the ions depositing on that surface.

Cementing of the powder particles onto the adjacent strip surface can be accomplished so long as the powder particles are substantially immobile relative to the strip surface. Such immobility, to the extent required, is obtained because site 39 and the portion of strip 30 which closes the site are stationary relative to each other when they both move together at the same speed. As a result, the electrolytic liquid in the relatively stationary site is also stationary relative to the strip portion which closes the site, and thus the particles suspended in that liquid are also stationary relative to the strip.

The cations which deposit on the strip surface from the electrolytic liquid at a given site must be deep enough to anchor the powder particles. Because of the inherent characteristics of the present invention, the electrical resistance at a closed, flooded site 39 is relatively small resulting in a relatively large current density in turn resulting in a relatively deep layer of cations which plate out of solution from the electrolytic liquid.

There are thus two factors which are responsible for allowing the co-deposition of (a) suspended powder particles with (b) cations plating out of solution from the electrolytic liquid, namely (1) the relative immobility of the powder particles in relation to the strip surface to which they are to be anchored, and (2) the relatively high current density available because of the inherent characteristics of the present invention.

The powder particles which are co-deposited may have the same composition as the cations, i.e., they may be both composed of zinc, or the powder particles may be composed of another metal such as aluminum or nickel. The powder particles may also have a non-metallic composition, e.g. silicon carbide.

When the powder particles have the same composition as the cations, the resulting coating contains substantially more metal than the theoretical amount which should have been deposited based on electroplating alone. As an example, the zinc coating weight may be increased by 30 to 40 percent, and larger increases are obtainable.

Although the powder undergoing co-deposition is relatively immobile relative to the strip surface on which it is deposited, the strip itself is moving at a relatively rapid speed which is conventional for a continuous electroplating line, e.g., 100–1,000 ft./min. (30—303 meters/min.). At this speed, and utilizing a plating roll 22 having a diameter of 3 ft. (about 1 meter), the time in which the particles are relatively immobile relative to the strip surface is in the range 0.3–3 seconds.

In one example of an embodiment of co-deposition, the powder particles in suspension had a diameter of about 5 micrometers, and the powder was added to the electrolytic liquid in a concentration of about 20 grams/liter.

A method and apparatus in accordance with the present invention can co-deposit on a surface of metal strip 30 two metals, e.g., zinc and nickel, at the same time, by providing salts or cations of each metal at the sites at which plating of the strip surface is performed and electroplating both cations out of solution. When two different cations are deposited on the strip surface by electroplating out of solution, one of these cations can come from the anode comprising outer layer 85 on roll 22 (e.g., a zinc anode at layer 85) and the other cation can be supplied to the electrolytic liquid before the liquid is introduced onto outer surface 28 of roll 22, e.g., in the manner illustrated in FIG. 2 at 65. As an alternative, each cation can come from the outer layer of a different respective roll 22, so long as each cation is anodically dissolveable, as would be the case with zinc and nickel. Thus, in one example, there may be a series of several successive rolls having outer layers of zinc followed by one or more rolls having outer layers of nickel, or vice versa, or other combinations of permutations thereof.

As noted above, tank 22 is provided solely to catch electrolytic liquid which drips down into the tank from the apparatus located above the tank. In no embodiment of the present invention is an electro-treating roll 22 immersed in or in contact with bath 21 of electrolytic liquid. Referring to FIGS. 2 and 5, the reason for maintaining roll 22 totally above bath 21 is to maintain strip 30 out of the electrolytic liquid and thereby prevent strip outer surfaces 34 from being plated with cations. The only surface of the strip on which cations are plated is strip surface 33, in the embodiment of FIG. 2, or strip surface 34 in the embodiment of FIG. 9.

In the embodiment of FIG. 9, wherein the strip is wrapped around the upper portion of roll 22 and electrolytic liquid is directed upwardly into upstream nip 144, the strip surface 33 is the strip surface uncontacted by the liquid. In this embodiment there is less plating out of cations on the strip surface which is not in direct contact with mesh layer 38 than occurs when the electrolytic liquid decends downwardly into the upstream nip, as in the embodiment of FIG. 2; and even in the embodiment of FIG. 2, the wrap-around around of plating metal is commercially insignificant and insubstantial.

In the embodiment illustrated in FIG. 2, there may at times possibly be a very slight amount of cations plating out around the strip edges, but this is relatively insignificant.

The amount of liquid which should be supplied to the upstream nips 44 or 144 should be just enough liquid to flood sites 39, 39, or perhaps slightly more. High pressure pumps need not be employed to force the liquid into the sites. The liquid is introduced into the sites at the upstream nip 44 or 144, before the sites are closed by strip 30, and the liquid is then trapped in the sites by the closing strip. The liquid cannot drain from the flooded sites while they are closed, and because of the manner and timing with which the liquid is introduced into the sites, the liquid does not have a chance to drain from the sites before they are closed.

It is not necessary to flush or to clean sites 39, 39. They are self-cleaning. Relatively little plating is done at a given site on a given roll, so that the small amount of agitation that is present there is enough to keep the site clean.

It is also unnecessary to employ heavy pumps to break up the film of depleted electrolytic liquid which forms on the strip surface which has been subjected to electro-plating. Movement of the strip over a roll 24 following the strip's subjection to electroplating on a roll 22 provides sufficient agitation of the strip surface to break up any electrolytic film which may be present.

A typical example of an embodiment of a method and apparatus employing the present invention utilizes 40 rolls 22 having a diameter of about three feet. This provides about five linear feet (1.5 m) of contact between the strip and each roll, or a total contact with the strip of about 200 linear feet assuming 40 rolls in the line. The strip moves along the line at a speed of about 500 ft./min. (152 meters/min.) and therefore the strip is in contact with the forty rolls for about 2/5 of a minute or about 24 seconds. At a current density of about 1,500 amps./ft.$^2$ (16,145 amps./m$^2$), the thickness of the zinc coating which is plated out on the metal strip is about 0.63 mils (0.16 mm). This example employed a lead anode and zinc sulfate solution.

Employing the same method and apparatus but with a current density of 1,000 amps./ft.$^2$ (10,760 amps./m$^2$) and a contact time of about 38 seconds, the resulting thickness of the electro-coated zinc is 0.75 mils (0.19 mm).

Although the foregoing description has been concerned principally with the electroplating of zinc, the present invention may also be used for the electroplating of other metals such as nickel, copper and chromium.

In the embodiments illustrated in the drawings, mesh layer 38 is shown as defining perpendicularly oriented site side walls 41, 41 all of which have the same depth so as to completely enclose a given site 38 when the site is covered by metal strip 30. In another embodiment, one pair of parallel side walls 41 (e.g. those extending parallel to the axis of roll 22) may have a greater depth than the other pair of parallel side walls (e.g. those extending in a circumferential direction along the roll's outer surface). In such a case, when strip 30 covers the site, there is a gap between the adjacent strip surface (e.g. 33) and the tip of the side walls having the lesser depth, and the side walls defined by the mesh only partially enclose a given site 38. As used herein, the term "site-enclosing side walls" encompasses partially enclosing as well as completely enclosing side walls.

Although, with partially enclosing side walls there are gaps in the side walls of a given site, this does not seriously interfere with electro-treating because, once a site has been flooded at the upstream nip, only an insubstantial amount of liquid will move laterally out of a partially enclosed site, through the gaps, during the relatively short period of time in which the site is covered by the strip. During this period the site will retain sufficient liquid to sustain the electro-treating process. The side walls of lesser depth cooperate with similar side walls on laterally aligned partially enclosed sites to act as barriers and restrictors to the lateral movement of liquid out of a given site while that site is covered.

A typical example of a partially enclosed site is one having a deeper set of parallel side walls of 0.06 in. (1.5 mm.) depth and a shallower set of side walls of 0.03 in. (0.75 mm.) depth. At such a site, the liquid is sufficiently immobile to permit the codeposition at that site of cations and suspended power particles, when metal strip 30 is trained under anodic roll 22 in the manner shown in FIG. 2.

To sustain the electro-treating process the various sites should be defined by a plurality of side walls which extend in directions having components either axially parallel or circumferential to the roll or both. The presence of gaps in the side walls (e.g. between side walls and an adjacent strip surface or between side walls and an adjacent roll outer surface or between the strip surface and the roll outer surface) is not critical so long as the totality of the side walls defined by the mesh layer sufficiently restrains lateral movement of liquid out of the sites to permit the performance of the electro-treating process. Thus a mesh layer defining side walls which are randomly oriented and irregularly spaced in three dimensions (e.g. with an orientation and irregular spacing exemplified by steel wool) may be used, so long as the criterion described in the preceding sentence is met.

In summary, as used herein, the term "site enclosing side walls" includes partially enclosing side walls which in turn includes the arrangements described in the preceding paragraph.

The foregoing detailed description has been given for clearness of understanding only, and no unnecessary limitations should be understood therefrom, as modifications will be obvious to those skilled in the art.

I claim:

1. An apparatus for electro-treating a continuous metal strip advancing in a downstream direction, said strip having a pair of side edges and a pair of opposed flat surfaces, said apparatus comprising the following structure:

a cylindrical roll having an outer surface composed of electrically conductive material;

a layer of mesh on said outer surface of the roll;

said mesh being composed of electrically insulating material;

said roll outer surface and said mesh defining a multiplicity of non-communicating open-end sites each having an inner base defined by a part of said roll outer surface, site-enclosing side walls defined by a part of said mesh and an open outer end opposite said base;

means for wrapping a portion of a continuous metal strip around a substantial portion of said roll to close the sites on that portion of the roll and to provide a pair of spaced-apart nips between said strip and said roll at the locations of initial upstream and final downstream contact between the strip and the roll;

said mesh layer comprising means for preventing direct electrical contact between said strip and said outer roll surface;

means for advancing said metal strip in a downstream direction and for simultaneously rotating said roll while maintaining the wrapped-around relationship between the strip and the roll and avoiding relative movement between (a) said strip and (b) said roll outer surface and mesh layer thereon, during said wrapped-around relationship;

means for introducing an electrolytic liquid onto the outer surface of the roll to flood the sites closed by said strip as the strip advances and the roll rotates;

means for charging said outer surface of the roll with a charge having a first polarity;

and means for charging said strip with a charge having a second polarity opposite said first polarity.

2. An apparatus as recited in claim 1 and comprising;

tank means located below said roll for catching electrolytic liquid descending from above said tank means at said upstream and downstream nips;

and means for controlling the level of liquid in said tank to maintain said level below said roll and said strip.

3. An apparatus as recited in claim 2 wherein:

said roll is horizontally disposed;

and said wrapping means comprises means for wrapping said strip around a lower portion of said roll;

said apparatus comprising arcuate electrode means located below said roll, substantially concentric therewith, and curved to conform to the curvature of said roll;

means for charging said electrode means with a charge having the same polarity as said outer surface of the roll;

said electrode means and said roll defining a space therebetween having a dimension in a radial direction greater than the thickness of said metal strip;

and means for introducing said electrolytic liquid into said space;

said means for controlling the level of liquid in said tank comprising means for maintaining said level below said electrode means.

4. An apparatus as recited in claim 1 and wherein:

said wrapping means and said advancing means for said strip comprise means cooperating to close a site once it has been flooded, to squeeze excess liquid from a flooded site at said upstream nip, to retain said liquid within said flooded site as the latter rotates between said upstream nip and said downstream nip, and to open said flooded site to permit the release of said liquid from the site as the site is rotated beyond said downstream nip and the strip advances downstream therefrom.

5. An apparatus as recited in claim 1 wherein:

said roll is horizontally disposed;

and said wrapping means comprises means for wrapping said strip around a lower portion of said roll.

6. An apparatus as recited in claim 5 wherein:

said introducing means comprises means for directing liquid onto an upper portion of said roll at least at said upstream nip.

7. An apparatus as recited in claim 1 wherein:

said roll is horizontally disposed;

said wrapping means comprises means for wrapping said strip around an upper portion of said roll;

and said introducing means comprises means for directing said liquid upwardly and initially into said upstream nip.

8. An apparatus as recited in claim 1 wherein said wrapping means comprises:

means for wrapping said strip around at least a 120° portion of said roll.

9. An apparatus as recited in claim 1 wherein:

said means for advancing said strip and for simultaneously rotating said roll comprises means for preventing slippage between the roll and the strip.

10. An apparatus as recited in claim 1 wherein:

said wrapping means comprises means for engaging one of said flat strip surfaces with said mesh layer so that portions of said one strip surface cover said open ends of said sites;

said apparatus comprising means, including all of said previously recited structure, for applying a coating of metal on said portions of said one strip surface which cover said open ends of the sites, without coating any substantial portion of the other surface of said strip.

11. An apparatus as recited in claim 1 wherein said charging means comprises:

means for making a cathode out of one of (a) said roll outer surface and (b) said strip and for making an anode out of the other;

said anode and cathode-making means comprising means cooperating to electrolytically clean the surface of said strip adjacent said roll outer surface.

12. An apparatus as recited in claim 1 wherein said means for wrapping said strip around said roll comprises:

a pair of additional rolls, one on each side of said first-recited roll;

means mounting each of said additional rolls for vertical movement to change the elevation of said additional rolls relative to said first-recited roll;

one of said additional rolls comprising means for engaging a portion of said strip upstream of the strip portion which is wrapped around said portion of the first-recited roll;

the other of said additional rolls comprising means for engaging a portion of said strip downstream of the strip portion which is wrapped around said portion of the first-recited roll;

and means, including said additional rolls and said mounting means for the additional rolls, for adjusting the length of the strip portion which is wrapped around and closes sites on a portion of the first-recited roll.

13. An apparatus as recited in claim 1 wherein said apparatus is for use in electrolytically coating a surface of said metal strip with another metal, and wherein:

said charging means comprises means for making said outer roll surface an anode and for making said strip a cathode;

and said outer roll surface is composed of said other metal with which said strip surface is to be coated.

14. An apparatus as recited in claim 13 wherein said mesh layer is unadhered to said roll, the diameter of said roll at said outer surface undergoes shrinkage during the electrolytic coating of said strip with said other metal, and said apparatus further comprises:

means for maintaining said layer of mesh in close, contacting engagement with said outer surface of the roll as the latter undergoes shrinkage.

15. An apparatus as recited in claim 14 wherein:

said mesh layer has a pair of sides and a pair of ends;

one end of said mesh layer being fixed to said roll;

said mesh layer having an arrangement, in relation to said roll outer surface, in which the mesh layer extends from said one end around said roll outer surface, overlaps said one end and terminates at said other end of the mesh layer;

said other end being free and unfixed relative to said roll.

16. An apparatus as recited in claim 15 wherein said engagement-maintaining means for the mesh layer comprises:

means, including (a) said arrangement of said mesh layer and (b) said means for advancing the metal strip, for rolling up said mesh layer around said roll as the outer roll surface undergoes shrinkage.

17. An apparatus as recited in claim 16 wherein:

said mesh layer comprises a plurality of mesh layer portions each having said arrangement in relation to said roll outer surface;

said mesh layer portions being disposed in adjacent, side-by-side relation and each extending around and covering a cylindrical portion of the outer surface of said roll;

said plurality of side-by-side mesh layer portions comprising means for accommodating changes in the outer roll surface diameter in an axial direction along said roll.

18. An apparatus as recited in claim 1 wherein said apparatus is for use in electrolytically coating a surface of said metal strip with another metal, and wherein:

said charging means comprises means for making said roll outer surface an anode and for making said strip a cathode;

said roll outer surface is composed of a conductive material different than the metal of said strip or the metal to be coated;

and said apparatus comprises means for supplying cations of said other metal to said electrolytic liquid before said liquid is introduced at said upstream nip.

19. An apparatus as recited in claim 18 and comprising:

tank means located below said roll for catching electrolytic liquid descending from above said tank means;

and pump means for recirculating liquid from said tank means to said introducing means;

said cation-supplying means comprising means for supplying said cations to said liquid in said tank means.

20. An apparatus as recited in claim 1 wherein said apparatus is for use in electrolytically coating a surface of said metal strip with at least one other metal, and wherein:

said charging means comprises means for making said roll outer surface an anode and for making said strip a cathode;

said outer roll surface is composed of a first of said other metals with which said strip surface is to be coated;

and said apparatus comprises means for supplying cations of a second of said other metals to said electrolytic liquid before said liquid is introduced at said upstream nip.

21. An apparatus as recited in claim 1 wherein said apparatus is for use in electrolytically coating a surface of said metal strip with at least one other metal, and wherein:

said charging means comprises means for making said roll outer surface an anode and for making said strip a cathode;

and said apparatus comprises means for supplying cations of two other metals to said electrolytic liquid before said liquid is introduced onto said roll.

22. An apparatus as recited in claim 1 wherein said apparatus is for use in electrolytically coating a surface of said metal strip with another metal, and wherein:

said charging means comprises means for making said roll outer surface an anode and for making said strip a cathode;

and said apparatus further comprises:

means for supplying cations of the metal to be coated to said electrolytic liquid;

means for suspending powder particles in said electrolytic liquid including said liquid which floods said closed sites;

and means for maintaining said powder particles sufficiently immobile in each such closed site, as said strip advances in said downstream direction, to cement at least some of said immobile particles onto the strip surface at the closed site, as anions in said electrolytic liquid plate out on said inner base.

23. An apparatus as recited in claim 22 wherein:

said means for maintaining said powder particles immobile comprises means for moving said metal strip and said mesh layer at the same relative speed.

24. An apparatus as recited in claim 1 wherein said mesh layer comprises:

means, including the spacing between opposite side walls on a site and the depth of said side walls, for preventing said metal strip from contacting said inner base on a site while maximizing the area of said outer end on the site.

25. An apparatus as recited in claim 24 wherein:

said depth of the side walls is greater than the depth of any deformity on said strip.

26. An apparatus as recited in claim 1 wherein:

said mesh layer comprises means for resisting deformation of said mesh layer due to the advancement downstream of said wrapped-around strip.

27. An apparatus as recited in claim 1 wherein:

said mesh layer is composed of a material which is chemically inert to said electrolytic liquid and which is resistant to oxidation when said outer roll surface is lead and said electrolytic liquid comprises a solution of zinc sulfate.

28. An apparatus as recited in claim 1 wherein:

said mesh layer is composed of a material which will maintain its physical and mechanical properties when subjected to electrolytic liquid at temperatures up to 212° F. (100° C.).

29. An apparatus as recited in claim 1 wherein:

said mesh layer is composed of a material which will maintain its physical and mechanical properties when subjected to electrolytic liquid at temperatures up to about 180° F. (82° C.).

30. An apparatus as recited in claim 1 wherein:

said mesh layer is composed of a material selected from the group which consists essentially of polyethylene, polyvinylchloride, polyvinyldichloride, polypropylene and equivalents thereof.

31. An apparatus as recited in claim 1 wherein:

said mesh layer comprises means, including the spacing between opposite side walls on a site and the depth of said side walls, for preventing said metal strip from contacting said inner base on a site while maximizing the area of said outer end on the site;

said depth of the side walls is greater than the depth of any deformity on said strip;

said mesh layer comprises means for resisting deformation of said mesh layer due to the advancement downstream of said wrapped-around strip;

said mesh layer is composed of a material which is chemically inert to said electrolytic liquid and which is resistant to oxidation when said outer roll surface is lead and said electrolytic liquid comprises a solution of zinc sulfate;

and said mesh layer is composed of a material which will maintain its physical and mechanical properties when subjected to electrolytic liquid at temperatures up to about 180° F. (82° C.).

32. An apparatus for electro-treating a continuous metal strip advancing in a downstream direction, said apparatus comprising the following structure:

a plurality of cylindrical rolls each having an outer surface composed of electrically conductive material;

said rolls being spaced apart in a downstream direction;

a layer of mesh on said outer surface of each roll;

said mesh being composed of electrically insulating material;

said outer roll surface and said mesh defining a multiplicity of non-communicating open-end sites on each roll, each site having an inner base defined by a part of said outer roll surface, site-enclosing side walls defined by a part of said mesh and an open outer end opposite said base;

means for wrapping a continuous metal strip around a substantial portion of each roll to close the sites on that portion of the roll and to provide a pair of spaced-apart nips between said strip and said roll at the locations of initial upstream and final downstream contact between the strip and the roll;

said mesh layer comprising means for preventing direct electrical contact between said strip and said roll outer surface;

means mounting each of said rolls for rotation;

means for advancing said metal strip in a downstream direction and for simultaneously rotating said rolls while maintaining the wrapped-around relationship between the strip and the rolls and avoiding relative movement between (a) said strip and (b) said roll outer surface and mesh layer thereon, during said wrapped-around relationship;

means for introducing an electrolytic liquid onto the outer surface of each roll to flood the sites closed by said strip as the strip advances and the rolls rotate;

means for charging said outer surface of each roll with a charge having a first polarity;

and means for charging said strip with a charge having a second polarity opposite said first polarity.

33. An apparatus as recited in claim 32 wherein:

said rolls are horizontally disposed;

said wrapping means comprises means for wrapping said strip around a lower portion of one roll and means for wrapping said strip around an upper portion of another roll;

and said introducing means comprises means for directing liquid onto an upper portion of said one roll at least at said upstream nip at that roll and means for directing said liquid upwardly into said upstream nip at said other roll.

34. An apparatus as recited in claim 32 wherein:

said sites defined on one of said rolls overlap the sites defined on another of said rolls.

35. An apparatus as recited in claim 32 wherein:

the outer surface of one of said rolls is composed of one metal the cations of which are to be plated on said strip;

and the outer surface of another of said rolls is composed of another metal the cations of which are to be plated on said strip.

36. Electro-treating structure comprising:

a cylindrical roll having an outer surface composed of electrically conductive material;

a layer of mesh on said outer surface of the roll;

said mesh being composed of electrically insulating material;

said outer roll surface and said mesh defining a multiplicity of non-communicating open-end sites each having an inner base defined by a part of said outer roll surface, site-enclosing side walls defined by a part of said mesh and an open outer end opposite said base.

37. Structure as recited in claim 36 wherein:

said mesh layer has a pair of sides and a pair of ends;

one end of said mesh layer being fixed to said roll;

said mesh layer having an arrangement, in relation to said roll outer surface, in which the mesh layer extends from said one end around said roll outer surface, overlaps said one end and terminates at said other end of the mesh layer;

said other end being free and unfixed relative to said roll.

38. Structure as recited in claim 36 wherein:

said mesh layer comprises a plurality of said mesh layer portions each having said arrangement in relation to said roll outer surface;

each mesh layer portion having a cylindrical shape;

said mesh layer portions being arranged in adjacent, side-by-side relation and each extending around and covering a cylindrical portion of the outer surface of said roll;

said plurality of side-by-side mesh layer portions comprising means for accommodating changes in the outer roll surface diameter in an axial direction along said roll.

39. Structure as recited in claim 36 and intended for use with a metal strip wrapped around a substantial portion of said roll, and advanced in a downstream direction while said roll rotates, wherein said mesh layer comprises:

means, including the spacing between opposite side walls on a site and the depth of said side walls, for preventing said metal strip from contacting said inner base on a site while maximizing the area of said outer end on the site.

40. Structure as recited in claim 39 wherein:

said depth of the side walls is greater than the depth of any deformity on said strip.

41. Structure as recited in claim 36 wherein:

said mesh layer comprises means for resisting deformation of said mesh layer due to advancement downstream of said wrapped-around strip.

42. Structure as recited in claim 36 and intended for use with an electrolytic liquid in contact therewith, wherein:

said mesh layer is composed of a material which is chemically inert to said electrolytic liquid and which is resistant to oxidation when said outer roll surface is lead and said electrolytic liquid is zinc sulfate.

43. Structure as recited in claim 36 and intended for use with an electrolytic liquid in contact therewith, wherein:

said mesh layer is composed of a material which will maintain its physical and mechanical properties when subjected to electrolytic liquid at temperatures up to about 180° F. (82° C.).

44. Structure as recited in claim 36 wherein:

said mesh layer is composed of a material selected from the group which consists essentially of polyethylene, polyvinylchloride, polyvinyldichloride, a polypropylene and equivalents thereof.

45. Structure as recited in claim 36 wherein:

said mesh layer comprises means, including the spacing between opposite side walls on a site and the depth of said side walls, for preventing said metal strip from contacting said inner base on a site while maximizing the area of said outer end on the side;

said depth of the side walls is greater than the depth of any deformity on said strip;

said mesh layer comprises means for resisting deformation of said mesh layer due to the advancement downstream of said wrapped-around strip;

said mesh layer is composed of a material which is chemically inert to said electrolytic liquid and which is resistant to oxidation when said outer roll surface is lead and said electrolytic liquid is zinc sulfate;

and said mesh layer is composed of a material which will maintain its physical and mechancial properties when subjected to electrolytic liquid at temperatures up to about 180° F. (82° C.).

46. A method for electro-treating a continuous metal strip advancing in a downstream direction, said strip having a pair of said edges and a pair of opposed flat surfaces, said method comprising the steps of:

providing a cylindrical roll having an outer surface composed of electrically conductive material;

providing said outer roll surface with a layer of mesh composed of electrically insulating material to define a multiplicity of open-end sites each having an inner base defined by a part of said outer roll surface, site-enclosing side walls defined by a part of said mesh and an open outer end opposite said base;

wrapping a portion of said continuous metal strip around a substantial portion of said roll to close the sites on that portion of the roll and to provide a pair of spaced-apart nips between said strip and said roll at the locations of initial upstream and final downstream contact between the strip and the roll;

interposing said mesh layer between said strip and said outer roll surface to prevent direct electrical contact between the strip and the outer roll surface;

advancing the metal strip in a downstream direction and simultaneously rotating said roll while maintaining the wrapped-around relationship between the strip and the roll and avoiding relative movement between (a) said strip and (b) said roll outer surface and mesh layer thereon, during said wrapped-around relationship;

introducing an electrolytic liquid onto the outer surface of the roll to flood the sites closed by said strip as the strip advances and the roll rotates;

charging the outer surface of the roll with a charge having a first polarity;

and charging said metal strip with a charge having a second polarity opposite said first polarity.

47. A method as recited in claim 46 and comprising:

providing a body of electrolytic liquid below said roll;

and maintaining said roll and said strip outside of said body of electrolytic liquid.

48. A method as recited in claim 47 wherein said method comprises:

arranging said roll in a horizontal disposition;

said wrapping step comprising wrapping said strip around an upper portion of said roll;

locating arcuate electrode means below said roll, substantially concentric therewith, and curved to conform to the curvature of said roll;

charging said electrode means with a charge having the same polarity as said outer surface of the roll;

said electrode means and said roll defining a space therebetween having a dimension in a radial direction greater than the thickness of said metal strip;

introducing electrolytic liquid into said space;

and maintaining said arcuate electrode means outside of said body of electrolytic liquid.

49. A method as recited in claim 47 and comprising:

catching, in said body of liquid, electrolytic liquid descending from above said body at said upstream and downstream nips;

and controlling the level of liquid in said body to maintain said level below said roll and said strip.

50. A method as recited in claim 46 and comprising:

closing a site with said advancing strip once the site has been flooded;

squeezing excess liquid from a flooded site at said upstream nip;

employing said advancing strip to retain said liquid within said closed, flooded site as the latter rotates between said upstream nip and said downstream nip;

and opening said flooded site to permit the release of said liquid from the site as the site is rotated beyond said downstream nip and the strip advances downstream therefrom.

51. A method as recited in claim 46 and comprising:

arranging said roll in a horizontal disposition;

said wrapping step comprising wrapping said strip around a lower portion of said roll.

52. A method as recited in claim 51 wherein said introducing step comprises:

directing said liquid initially onto an upper portion of said roll at least at said upstream nip.

53. A method as recited in claim 46 and comprising:

arranging said roll in a horizontal disposition;

said wrapping step comprising wrapping said strip around an upper portion of said roll;

and said introducing step comprises directing said liquid upwardly and initially into said upstream nip.

54. A method as recited in claim 46 wherein said wrapping step comprises:

wrapping said strip around at least a 120° portion of said roll.

55. A method as recited in claim 54 wherein said wrapping step comprises:

wrapping said strip around up to a 270° portion of said roll.

56. A method as recited in claim 46 and comprising:

preventing slippage between said advancing strip and said rotating roll.

57. A method as recited in claim 46 and comprising:

engaging one of said flat strip surfaces with said mesh layer and covering said open ends of said sites with portions of said one strip surface;

and applying a coating of metal on said portions of said one strip surface which cover said open ends of the sites, without coating any substantial portion of the other surface of said strip.

58. A method as recited in claim 46 wherein:

said charging steps comprise making a cathode out of one of (a) said roll outer surface and (b) said strip and making an anode out of the other;

said method comprising electrolytically cleaning the surface of said strip adjacent said roll outer surface.

59. A method as recited in claim 46 and comprising:

adjusting the length of the strip portion which is wrapped around and closes sites on a portion of said roll.

60. A method as recited in claim 46 and for electrolytically coating a surface of said metal strip with another metal, and wherein:

said charging steps comprise making said roll outer surface an anode and said strip a cathode;

and said roll outer surface is composed of said other metal with which said strip surface is to be coated.

61. A method as recited in claim 60 and comprising:

providing said mesh layer on said roll outer surface without adhering the mesh layer to the roll outer surface;

depleting said roll outer surface of metal to coat said metal strip, thereby shrinking said roll at its outer surface as said metal is depleted;

and maintaining said layer of mesh in close, contacting engagement with said outer surface of the roll as the latter undergoes shrinkage.

62. A method as recited in claim 61 wherein said step of maintaining said mesh layer in close, contacting engagement with said outer roll surface comprises:

rolling up said mesh layer around said roll, in response to the advancement of said strip, as said outer roll surface undergoes shrinkage.

63. A method as recited in claim 60 wherein:

said roll outer surface is composed of zinc;

and said electrolytic liquid comprises a solution of zinc chloride.

64. A method as recited in claim 46 wherein:

said roll outer surface is composed of graphite;

and said electrolytic liquid comprises a solution of zinc chloride.

65. A method as recited in claim 46 and for electrolytically coating a surface of said metal strip with another metal, and wherein:

said charging steps comprise making said roll outer surface an anode and said strip a cathode;

and said roll outer surface is composed of a conductive material other than the metal of said strip or the metal to be coated;

said method comprising supplying cations of said other metal to said electrolytic liquid before said liquid is introduced at said upstream nip.

66. A method as recited in claim 65 wherein:

said metal to be coated is zinc;

said roll outer surface is composed of lead;

and said electrolytic liquid comprises a solution of zinc sulfate.

67. A method as recited in claim 46 and for electrolytically coating a surface of said metal strip with at least one other metal, and wherein:

said charging steps comprise making said roll outer surface an anode and said strip a cathode;

and said roll outer surface is composed of a first to said other metals with which said strip surface is to be coated;

and said method comprises supplying cations of a second or said other metals to said electrolytic liquid before said liquid is introduced onto said roll outer surface.

68. A method as recited in claim 46 and for electrolytically coating a surface of said metal strip with at least one other metal, wherein:

said method comprises supplying cations of two other mteals to said electrolytic liquid before said liquid is introduced at said upstream nip.

69. A method as recited in claim 46 and for electrolytically coating a surface of said metal strip with another metal, and wherein:

said charging steps comprise making said roll outer surface an anode and said strip a cathode;

and said method further comprises:

supplying cations of the metal to be coated to said electrolytic liquid;

suspending powder particles in said electrolytic liquid including the liquid which floods said sites;

and maintaining said powder particles sufficiently immobile in each such closed site, as said strip advances in said downstream direction, to cement at least some of said immobile particles onto said inner base of the closed site, as cations in said electrolytic liquid plate out on said inner base.

70. A method as recited in claim 69 wherein:

said maintaining step comprises advancing said metal strip and rotating said mesh layer with said roll at the same relative speed.

71. A method as recited in claim 46 wherein:

said method provides a current density in the range 900–1,500 amps./ft.$^2$ (9,690–15,840 amps./m$^2$) for a voltage of 15 volts and proportionate current densities for other voltages.

72. A method for electro-treating a continuous metal strip advancing in a downstream direction, said strip having a pair of side edges and a pair of opposed flat surfaces, said method comprising the steps of:

providing a plurality of cylindrical rolls each having an outer surface composed of electrically conductive material;

spacing said rolls apart in a downstream direction;

providing each outer roll surface with a layer of mesh composed of electrically insulating material to define a multiplicity of non-communicating open-end sites on each roll, each site having an inner base defined by a part of said outer roll surface, site-enclosing side walls defined by a part of said mesh and an open outer end opposite said base;

wrapping a portion of said continuous metal strip around a substantial portion of each roll to close the sites on that portion of the roll and to provide a pair of spaced-apart nips between said strip and said roll at the locations of initial upstream and final downstream contact between the strip and the roll;

interposing said mesh layer between said strip and said outer roll surface to prevent direct electrical contact between the strip and the outer roll surface;

advancing the metal strip in a downstream direction and simultaneously rotating said rolls while maintaining the wrapped-around relationship between the strip and the rolls and avoiding relative movement between (a) said strip and (b) said roll outer surface and mesh layer thereon, during said wrapped-around relationship;

introducing an electrolytic liquid onto the outer surface of each roll to flood the sites closed by said strip as the strip advances and the rolls rotate;

charging the outer surface of each roll with a charge having a first polarity;

and charging said metal strip with a charge having a second polarity opposite said first polarity.

73. A method as recited in claim 72 and comprising:

arranging said rolls in a horizontal disposition;

said wrapping step comprising wrapping said strip around a lower portion of one roll and around an upper portion of another roll;

said introducing step comprising directing said liquid onto an upper portion of said one roll at least at the upstream nip at that roll and directing said liquid upwardly and initially into said upstream nip at said other roll.

74. A method as recited in claim 72 wherein said step of covering each outer roll surface with said layer of mesh comprises:

defining sites on one of said rolls which overlap the sites defined on another of said rolls.

75. A method as recited in claim 72 wherein:

the outer surface of one of said rolls is composed of one metal the cations of which are to be plated on said strip;

and the outer surface of another of said rolls is composed of another metal the cations of which are to be plated on said strip;

said method comprising plating cations from each of said rolls onto said strip.

76. An apparatus for electrolytically plating a continuous metal strip advancing in a downstream direction, said strip having a pair of side edges and a pair of opposed flat surfaces, said apparatus comprising the following structure:

a horizontally disposed cylindrical roll having an outer surface composed of electrically conductive material;

means for wrapping a portion of a continuous metal strip around a lower portion of said roll with an inner surface of said strip adjacent said outer surface of said roll;

a porous mesh layer composed of electrically insulating material and covering that portion of the roll around which said strip portion is wrapped;

means for advancing said metal strip in a downstream direction and for simultaneously rotating said roll while maintaining the wrapped-around relationship between the strip and the roll;

and means for electrolytically plating the inner surface of said wrapped-around portion of the strip, from one side edge of the strip to the other side edge thereof, as said strip advances in a downstream direction, without plating the other surface of said strip.

77. An apparatus as recited in claim 76 wherein said last-recited means comprises:

means for directing electrolytic liquid initially onto an upper portion of said roll;

means for maintaining electrolytic liquid between said roll outer surface and said inner surface of the wrapped-around portion of the strip, from one side edge of the strip to the other side edge thereof;

and means for maintaining the outer surface of said strip out of contact with electrolytic liquid.

78. A method for electrolytically plating a continuous metal strip advancing in a downstream direction, said strip having a pair of side edges and a pair of opposed flat surfaces, said method comprising the steps of:

providing a horizontally disposed cylindrical roll having an outer surface composed of electrically conductive material;

wrapping a portion of said continuous metal strip around a lower portion of said roll with an inner surface of said strip adjacent said outer surface of said roll;

covering that portion of the roll around which said strip portion is wrapped with a porous mesh layer composed of electrically insulating material;

advancing the metal strip in a downstream direction and simultaneously rotating said roll while maintaining the wrapped-around relationship between the strip and the roll;

and electrolytically plating the inner suface of said wrapped-around portion of the strip, from one side edge of the strip to the other side edge thereof, as said strip advances in a downstream direction, without plating the other surface of said strip.

79. A method as recited in claim 78 wherein said last recited step comprises:

directing electrolytic liquid initially onto an upper portion of said roll;

maintaining electrolytic liquid between said roll outer surface and said inner surface of the wrapped-around portion of the strip, from one side edge of the strip to the other side edge thereof;

and maintaining the outer surface of said strip out of contact with electrolytic liquid.

80. An apparatus for electrolytically plating a continuous metal strip advancing in a downstream direction, said strip having a pair of side edges and a pair of opposed flat surfaces, said apparatus comprising the following structure:

a horizontally disposed cylindrical roll having an outer surface composed of electrically conductive material;

means for wrapping a portion of a continuous metal strip around an upper portion of said roll, with an inner surface of said strip adjacent said outer surface of said roll, to provide a pair of spaced-apart nips between said strip and said roll at the locations of initial upstream and final downstream contact between the strip and the roll;

a porous mesh layer composed of electrically insulating material and covering that portion of the roll around which said strip portion is wrapped;

means for advancing said metal strip in a downstream direction and for simultaneously rotating said roll while maintaining the wrapped-around relationship between the strip and the roll;

and means for electrolytically plating the inner surface of said wrapped-around portion of the strip, from one side of the strip to the other side edge thereof, as said strip advances in a downstream direction, without plating the other surface of said strip;

said last recited means comprising means for directing electrolytic liquid upwardly and initially into said upstream nip.

81. An apparatus as recited in Claim 80 wherein said plating means comprises:

means for maintaining electrolytic liquid between said roll outer surface and said inner surface of the wrapped-around portion of the strip, from one side edge of the strip to the other side edge thereof, and from one of said nips to the other;

and means for maintaining the outer surface of said strip out of contact with electrolytic liquid.

82. A method for electrolytically plating a continuous metal strip advancing in a downstream direction, said strip having a pair of side edges and a pair of opposed flat surfaces, said method comprising the steps of:

providing a horizontally disposed cylindrical roll having an outer surface composed of electrically conductive material;

wrapping a portion of said continuous metal strip around an upper portion of said roll, with an inner surface of said strip adjacent said outer surface of said roll, to provide a pair of spaced-apart nips between the strip and said roll at the locations of initial upstream and final downstream contact between the strip and the roll;

covering that portion of the roll around which said strip is wrapped with a porous mesh layer composed of electrically insulating material;

advancing the metal strip in a downstream direction and simultaneously rotating said roll while maintaining the wrapped-around relationship between the strip and the roll;

and electrolytically plating the inner surface of said wrapped-around portion of the strip, from one side edge of the strip to the other side edge thereof, as said strip advances in a downstream direction, without plating the other surface of said strip;

said last-recited step comprising directing electrolytic liquid upwardly and initially into said upstream nip.

83. A method as recited in claim 82 wherein said plating step comprises:

maintaining electrolytic liquid between said roll outer surface and said inner surface of the wrapped-around portion of the strip, from one side edge of the strip to the other side edge thereof, and from one of said nips to the other;

and maintaining the outer surface of said strip out of contact with electrolytic liquid.

* * * * *

UNITED STATES PATENT AND TRADEMARK OFFICE

CERTIFICATE OF CORRECTION

PATENT NO. : 4,430,166

DATED : 2/7/84

INVENTOR(S) : William A. Carter

It is certified that error appears in the above-identified patent and that said Letters Patent are hereby corrected as shown below:

Col. 1, line 39, "cation's" should be --cations--;

Col. 1, line 41, "cation's" should be --cations--;

Col. 2, line 10, "abovedescribed" should be --above-described--;

Col. 3, line 17, "side-enclosing" should be --site-enclosing--;

Col. 3, line 51, "(0,690-16-b 145" should be --(9,690-16,145--;

Col. 8, line 47, "anions" should be --cations--;

Col. 16, line 62, "surfaces 34" should be --surface 34--;

Col. 17, line 7, "wrap-around around" should be --wrap-around--;

Col. 17, line 55, "(0.19)" should be --(.019)--;

Col. 18, line 28, "power" should be --powder--

Col. 20, line 67, "outer roll surface" should be --roll outer surface--;

Col. 22, line 4, "outer roll surface" should be --roll outer surface--;

UNITED STATES PATENT AND TRADEMARK OFFICE

CERTIFICATE OF CORRECTION

PATENT NO. : 4,430,166

DATED : 2/7/84

INVENTOR(S) : William A. Carter

It is certified that error appears in the above-identified patent and that said Letters Patent are hereby corrected as shown below:

Col. 22, line 37, "anions" should be --cations--;

Col. 25, line 28, "a" should be deleted;

Col. 25, line 53, "said edges" should be --side edges--;

Col. 28, line 19, "first to" should be --first of--;

Col. 28, line 23, "or said" should be --of said--;

Col. 28, line 30, "mteals" should be --metals--;

Col. 28, line 54, "15,840" should be --16,145--

Signed and Sealed this

*Eleventh* Day of *September 1984*

[SEAL]

*Attest:*

GERALD J. MOSSINGHOFF

*Attesting Officer*

*Commissioner of Patents and Trademarks*